US006226816B1

(12) United States Patent
Webster et al.

(10) Patent No.: US 6,226,816 B1
(45) Date of Patent: May 8, 2001

(54) PROCEDURAL STRETCHER RECLINE CONTROLS

(75) Inventors: Thomas Matthew Webster, Cleves, OH (US); James L. Walke; Charles A. Howell, both of Batesville, IN (US)

(73) Assignee: Hill-Rom, Inc., Batesville, IN (US)

( * ) Notice: Subject to any disclaimer, the term of this patent is extended or adjusted under 35 U.S.C. 154(b) by 0 days.

(21) Appl. No.: 09/123,813

(22) Filed: Jul. 28, 1998

Related U.S. Application Data

(63) Continuation of application No. 08/735,510, filed on Oct. 23, 1996.

(51) Int. Cl.[7] ..... A47C 21/08

(52) U.S. Cl. ..... 5/618; 5/424; 5/425

(58) Field of Search ..... 5/617, 618, 424, 5/425, 663

(56) References Cited

U.S. PATENT DOCUMENTS

| | | | | |
|---|---|---|---|---|
| 1,941,214 | | 12/1933 | Kusterle | 5/617 |
| 3,010,121 | | 11/1961 | Breach . | |
| 3,216,026 | | 11/1965 | Mann . | |
| 3,436,769 | | 4/1969 | Burst . | |
| 3,593,350 | | 7/1971 | Knight et al. . | |
| 3,913,153 | | 10/1975 | Adams et al. . | |
| 3,932,903 | | 1/1976 | Adams et al. . | |
| 3,972,081 | | 8/1976 | Stern et al. . | |
| 4,014,344 | | 3/1977 | Guotierrez . | |
| 4,183,015 | | 1/1980 | Drew et al. | 5/425 |
| 4,222,121 | | 9/1980 | Holdt et al. | 5/617 |
| 4,409,695 | | 10/1983 | Johnston et al. . | |
| 4,484,367 | * | 11/1984 | Jenkins | 5/425 |
| 4,534,077 | | 8/1985 | Martin | 5/616 |
| 4,545,084 | | 10/1985 | Peterson . | |
| 4,559,655 | | 12/1985 | Peck . | |
| 4,592,104 | | 6/1986 | Foster et al. . | |
| 4,612,679 | * | 9/1986 | Mitchell | 5/425 |
| 4,629,242 | | 12/1986 | Schrager . | |
| 4,723,808 | | 2/1988 | Hines et al. . | |
| 4,751,754 | | 6/1988 | Bailey et al. . | |

(List continued on next page.)

FOREIGN PATENT DOCUMENTS 0 505 312 A1 9/1992 (EP) .

OTHER PUBLICATIONS

Extened Stay Stretcher Model 1550, Stryker® Patient Handling Advertising Literature, 5 pages, 1993.

Renaissance Series Head & Neck Surgery Stretcher Model 1068, Stryker® Patient Handling Advertising Literature, 6 pages, 1993.

A Hill–Rom Solution, "Clinitron Up–Lift Air Fluidized Therapy", 4 pages, 1996.

*Primary Examiner*—Terry Lee Melius
*Assistant Examiner*—F. Couley
(74) *Attorney, Agent, or Firm*—Barnes & Thornburg

(57) ABSTRACT

A stretcher includes a first actuator coupled to a head section and a second actuator coupled to a thigh section. A set of buttons accessible to a patient carried by the stretcher are coupled to motors that drive the respective first and second actuators. The buttons are pressed to move the thigh section through a fill range of motion and to move the head section through a limited range of motion. A switch inaccessible to the patient is pressed to move the head section through a full range of motion. Lockout switches are provided for disabling the buttons and the switch. A first hand crank is coupled to the first actuator and is manually rotated to move the head section through the full range of motion. A second hand crank is coupled to the second actuator and is manually rotated to move the thigh section through the fill range of motion. A CPR release handle is provided for quickly lowering the head section to the lowered position without the use of the buttons, switch, or first hand crank.

4 Claims, 21 Drawing Sheets

U.S. PATENT DOCUMENTS

| | | | | |
|---|---|---|---|---|
| 4,912,787 | | 4/1990 | Bradcovich | 5/617 |
| 4,985,946 | | 1/1991 | Foster et al. . | |
| 5,054,141 | | 10/1991 | Foster et al. . | |
| 5,072,463 | | 12/1991 | Willis . | |
| 5,083,332 | | 1/1992 | Foster et al. . | |
| 5,095,562 | | 3/1992 | Alexander . | |
| 5,129,116 | | 7/1992 | Borders et al. . | |
| 5,179,744 | | 1/1993 | Foster et al. . | |
| 5,195,198 | | 3/1993 | Travis . | |
| 5,230,113 | * | 7/1993 | Foster et al. | 5/608 |
| 5,343,581 | | 9/1994 | Bartley et al. . | |
| 5,377,370 | | 1/1995 | Foster et al. . | |
| 5,394,580 | | 3/1995 | Foster et al. . | |
| 5,423,097 | | 6/1995 | Brule' et al. . | |
| 5,444,880 | | 8/1995 | Weismiller et al. . | |
| 5,878,452 | * | 3/1999 | Brooke et al. | 5/428 |

* cited by examiner

PROCEDURAL STRETCHER RECLINE CONTROLS

This Appln is a con't of Ser. No. 08/735,510 filed Oct. 23, 1996.

BACKGROUND AND SUMMARY OF THE INVENTION

The present invention relates to a stretcher for use in a hospital or other health care facility, and particularly to a procedural stretcher including an articulated patient support having a movable section that can be moved by a drive mechanism. More particularly, the present invention relates to a stretcher having a drive mechanism including both an automatic mechanized drive assembly and a manual hand-operated drive assembly, each of which operate to move the movable section of the patient support.

Stretchers for transporting a patient in a hospital or other health care facility from one location to another are well known. Conventional stretchers may include an articulated patient-support deck having sections that can be adjusted to adjust the position of the patient. See, for example, U.S. Pat. Nos. 4,723,808 to Hines and 4,629,242 to Schrager, each of which discloses a patient support deck having a movable head section.

Many stretchers having movable patient-support sections include hand-operated assemblies that can be manually operated to adjust the position of the patient-support sections. For example, each of the Hines '808 patent and the Schrager '242 patent discloses a stretcher having a shaft coupled to a movable patient-support section and a hand crank for rotating the shaft to adjust the position of the movable patient-support section.

Hospital beds are generally less mobile than stretchers and typically are not used to transport patients between locations, but rather remain at a single location during use when a patient rests on the bed. Hospital beds may also be provided with articulated patient supports having sections that can be adjusted to place the patient resting on the bed in a variety of positions. See, for example, U.S. Pat. Nos. 5,444,880 to Weismiller et al.; 4,751,754 to Bailey et al.; 4,559,655 to Peck; and 3,436,769 to Burst; all of which are assigned to the assignee of the present invention, and see also, U.S. Pat. Nos. 5,423,097 to Brule et al. and 4,545,084 to Peterson. Each of these references discloses a hospital bed having articulated head, seat, thigh, and foot sections, at least one of which can be moved to adjust the position of the patient.

Some hospital beds having articulated patient-support sections have manual hand-operated assemblies that can be operated to adjust the position of the movable sections and some have mechanized assemblies that can be actuated to adjust the position of the movable sections. For example, each of the Brule et al. '097 patent and the Peterson '084 patent discloses a hospital bed having a manually rotated hand crank to raise and lower the movable sections of the bed. See also the Weismiller et al. '880 patent, the Bailey et al. '754 patent, the Peck '655 patent, and the Burst '769 patent which are assigned to the assignee of the present invention, and see U.S. Pat. No. 5,329,657 to Bartley et al, each of which discloses a hospital bed having an electric motor that can be activated to raise and lower the movable sections of the bed.

Hospital beds having mechanized assemblies that adjust the movable sections may include patient control buttons that are accessible by the patient for actuating the mechanized assemblies to adjust the positions of the sections to a desired position. In addition, such hospital beds may include limit switches to limit the ranges of motion of designated sections and lockout switches that can be activated by a caregiver to deactivate the patient control buttons. See, for example, U.S. Pat. Nos. 4,044,286 to Adams et al. and 3,913,153 to Adams et al., both of which are assigned to the assignee of the present invention and both of which disclose the use of a limit switch limiting the movement of the movable sections and a lockout switch that can be moved to a position preventing an electric motor from being actuated by the patient control buttons.

Hospital beds having a movable head section may include a manually operated quick-release handle for rapidly lowering the head section, for example, when a patient goes into cardiac arrest, so that cardiopulmonary resuscitation (CPR) can be administered to the patient. See, for example, the Weismiller et al. '880 patent, the Peck '655 patent, and U.S. Pat. No. 5,129,116 to Borders et al., all of which are assigned to the assignee of the present invention, and see U.S. Pat. No. 5,329,657 to Bartley et al. Each of these references discloses a mechanism that can be actuated to rapidly lower the head section to a flat position.

What is desired is a stretcher having a drive mechanism including both a mechanized drive and a hand-operated drive, each of which can be used to adjust the same movable section of the patient-support deck. The mechanized drive should be usable to move the movable section when the stretcher is generally stationary and receiving power from an external power source. The hand-operated drive should be manually actuatable to move the movable section both when the stretcher is connected to the external power source and when the stretcher is disconnected from the external power source. Such a stretcher should also include patient control buttons accessible by the patient to actuate the mechanized drive and caregiver control switches accessible by a caregiver to actuate the mechanized drive. Additionally, the stretcher should include hand cranks that are accessible by the caregiver to manually actuate the hand-operated drive. The stretcher should also include a CPR mechanism having a CPR release handle that, when actuated, allows a head section of a patient-support deck to quickly lower to a generally horizontal table position.

According to the present invention, a stretcher is provided having a frame and a patient-support deck mounted on the frame. The patient-support deck includes longitudinally spaced-apart sections. At least one of the sections is a movable section that is coupled to the frame for pivoting movement relative to the other deck sections between a raised position and a lowered position through an intermediate position therebetween. The stretcher includes a drive mechanism that, when actuated, moves the movable section relative to the other deck sections. The drive mechanism is coupled to the frame and coupled to the movable section.

The drive mechanism includes a hand-operated drive for moving the movable section between the raised position and the lowered position and a mechanized drive for moving the movable section between the raised position and the lowered position. Control buttons are coupled to the mechanized drive and the control buttons are engageable to activate the mechanized drive to lower the movable section from the raised position to the lowered position and to raise the movable section from the lowered position only to the intermediate position. The control buttons are configured so that the mechanized drive does not activate to move the movable section from the intermediate position toward the raised position in response to engagement of the control buttons.

In preferred embodiments, the stretcher includes a frame and a patient-support deck having articulated head, seat, thigh, and foot sections mounted to the frame. The thigh section is coupled to the frame for pivoting movement between a raised position raising the knees of the patient and a lowered position. A thigh section actuator that extends and retracts is coupled to the thigh section and to the frame. The thigh section actuator moves the thigh section between the raised position and the lowered position.

The head section is coupled to the frame for pivoting movement and is infinitely positionable between a generally vertical raised position and a generally horizontal lowered position through an intermediate position therebetween. A head section actuator that extends and retracts is coupled to the head section and to the frame. The actuator moves the head section between the raised position and the lowered position. However, movement of the head section relative to the thigh section is limited under certain circumstances to limit the extent to which the patient can close the angle defined between the head section and the thigh section. In addition, a CPR mechanism having a release handle is coupled to the head section actuator so that when the release handle is actuated, the head section quickly moves to the lowered position.

A head section motor is coupled to the head section actuator to drive the head section actuator and a thigh section motor is coupled to the thigh section actuator to drive the thigh section actuator. Patient control buttons are mounted on a side guard rail and coupled to each motor so that patient control buttons can be pressed to activate the motors. Caregiver control switches are mounted on the frame of the stretcher at a foot end of the stretcher away from the patient but accessible by the caregiver attending to the patient and are coupled to at least one of the motors so that caregiver control switches can be actuated to activate at least one of the motors. In addition, a pair of hand cranks are mounted on the frame of the stretcher at the foot end of the stretcher. One hand crank can be manually rotated to drive the head section actuator to move the head section between the raised and lowered positions and the other hand crank can be manually rotated to drive the thigh section actuator to move the thigh section between the raised and lowered positions.

The patient control buttons can be pressed to operate the motors to drive the actuators and move the thigh section between the raised and lowered positions, move the head section from the raised position to the lowered position, and move the head section from the lowered position to the intermediate position. However, the patient control buttons are configured so that the patient control buttons do not operate the motors to move the head section toward the raised position past the intermediate position. Thus, the extent to which the patient control buttons can be used to activate the head section motor to move the head section toward the raised position, closing the angle between the head section and the thigh section, is limited.

The caregiver control switches operate the head section motor to move the head section to desired positions within the full range of motion of the head section between the raised and lowered positions. Additionally, the hand cranks also operate the head and thigh section actuators to move the head and thigh sections to desired positions within the full range of motion of the head and thigh sections.

Thus, the head and thigh section motors provide a mechanized drive to drive the actuators and adjust the position of the head and thigh sections, respectively. In addition, the hand cranks provide a hand-operated drive to drive the actuators and adjust the position of the head and thigh sections. The caregiver can use both the mechanized drive and the hand-operated drive to adjust the position of the head and thigh sections through the full range of motion of the head and thigh sections. The patient can use only the mechanized drive to adjust the position of the head and thigh sections and can only raise the head section up to the intermediate position. However, the patient can use the mechanized drive to lower the head section from any position down to the lowered position when the stretcher receives power from an external power source.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
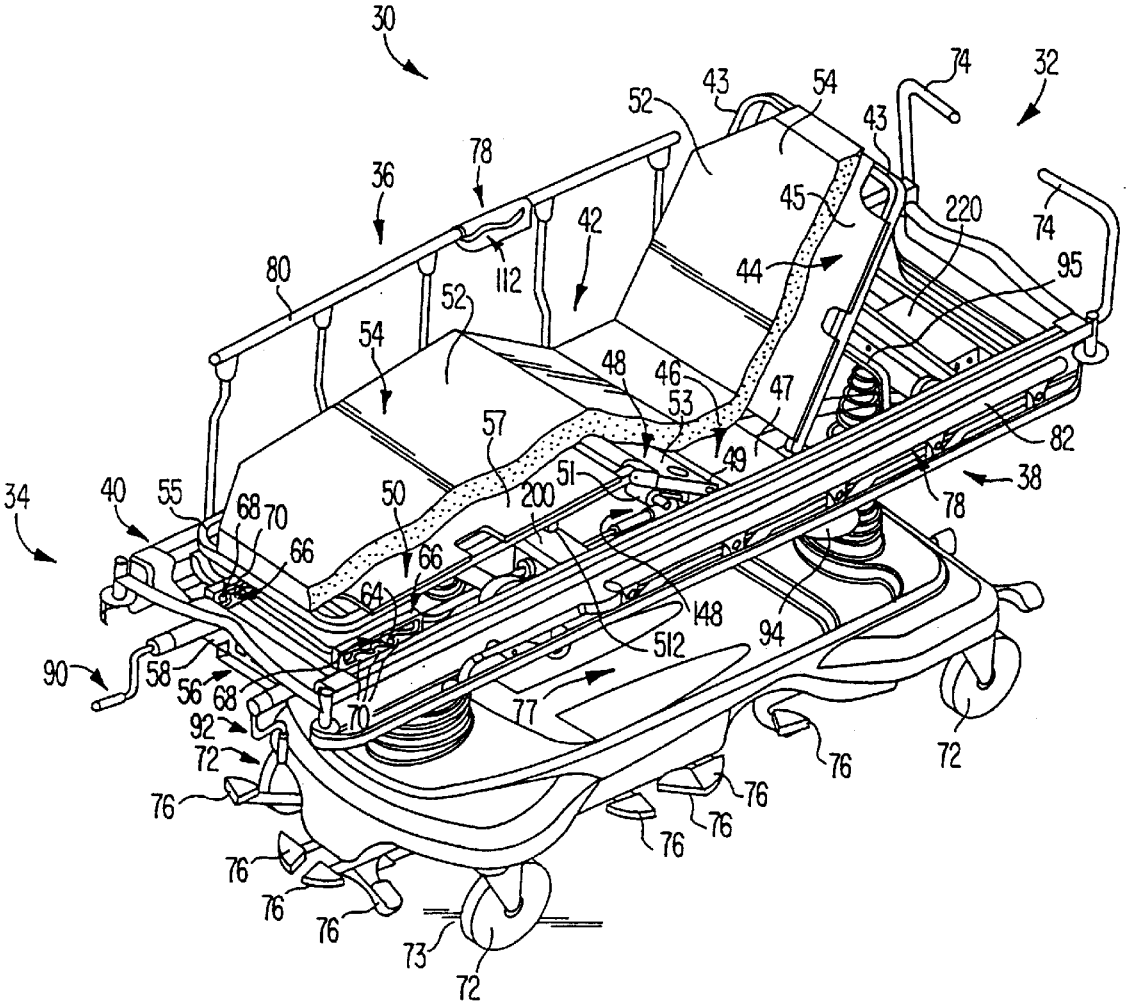
FIG. 1 is a perspective view of a stretcher in accordance with the present invention with portions broken away showing the stretcher including an articulated patient-support deck having longitudinally spaced-apart head, seat, thigh, and foot sections, patient control buttons mounted to a side guard rail, caregiver control switches mounted to a frame at a foot end of the stretcher, and head and thigh section hand cranks mounted to the frame at the foot end of the stretcher.

A stretcher 30 in accordance with the present invention has a head end 32, a foot end 34, an elongated first side 36, and an elongated second side 38, as shown in FIG. 1. As used in this description, the phrase "head end 32" will be used to denote the end of any referred-to object that is positioned to lie nearest head end 32 of stretcher 30 and the phrase "foot end 34" will be used to denote the end of any referred-to object that is positioned to lie nearest foot end 34 of stretcher 30. Likewise, the phrase "first side 36" will be used to denote the side of any referred-to object that is positioned to lie nearest first side 36 of stretcher 30 and the phrase "second side 38" will be used to denote the side of any referred-to object that is nearest second side 38 of stretcher 30. Although the present invention is described below with reference to stretcher 30, the features of the present invention could be used on a bed, a table, or any other patient-support device.

Stretcher 30 includes a frame 40 and an articulated patient-support deck 42 carried by frame 40 as shown in FIG. 1. Deck 42 includes head, seat, thigh, and foot sections 44, 46, 48, 50 that are longitudinally spaced-apart from head end 32 to foot end 34 of stretcher 30. A mattress 52 is supported by deck 42 and mattress 52 includes a generally upwardly-facing patient-support surface 54 on which a patient can lie.

Frame 40 includes transversely-extending spaced-apart first and second transverse members 49 and seat section 46 includes a support panel 47 fixed to transverse members 49. Head section 44 includes a generally U-shaped frame member 43 and a support panel 45 fixed to frame member 43. Thigh section 48 includes a frame member 51 and a support panel 53 fixed to frame member 51. Foot section 50 includes a generally U-shaped frame member 55 and a support panel 57 fixed to frame member 55.

Figure 6:
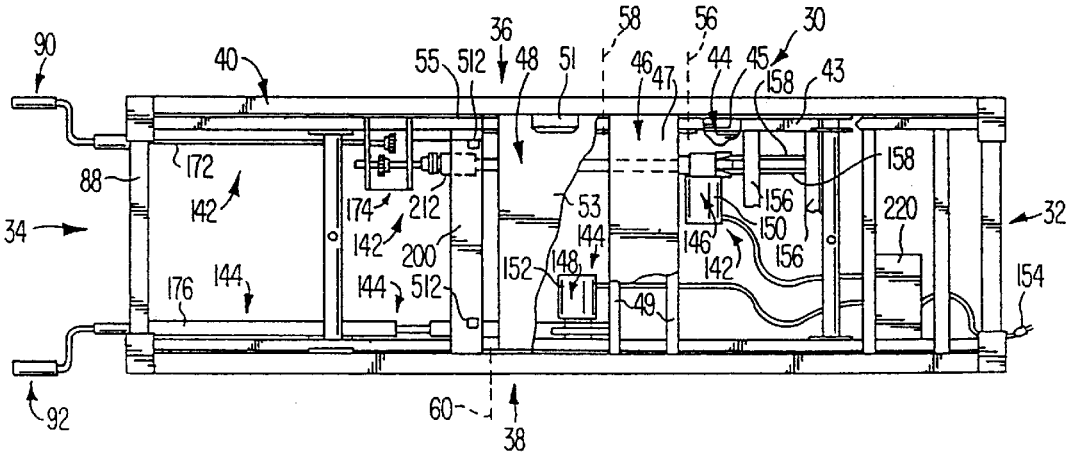
FIG. 6 is a top plan view of the stretcher of FIG. 5 showing the head section hand crank coupled to the head section actuator by a head section crank shaft and a gear box, the head section actuator and crank shaft mounted to the frame adjacent to a first side of the stretcher, the thigh section hand crank coupled to the thigh section actuator by a thigh section crank shaft, and the thigh section actuator and thigh section crank shaft being mounted to the frame adjacent to a second side of the stretcher.

Foot end 34 of frame member 43 is pivotably coupled to first transverse member 49 so that head section 44 is pivotably coupled to seat section 46 for pivoting movement about a transversely-extending first pivot axis 56, as shown in FIG. 6. Head end 32 of frame member 51 is pivotably coupled to second transverse member 49 so that thigh section 48 is pivotably coupled to seat section 46 for pivoting movement about a transversely-extending second pivot axis 58. Head end 32 of frame member 55 of foot section 50 is pivotably coupled to foot end 34 of frame member 51 of thigh section 58 so that foot section 50 is coupled to thigh section 48 for pivoting movement about a transversely-extending third pivot axis 60.

Head section 44 is pivotable about axis 56 and is infinitely positionable between a raised position extending upwardly and generally vertically from frame 40 and a lowered position laying generally horizontally against frame 40. Head section 44 has an intermediate position between the raised and lowered positions, as shown, for example, in FIG. 7 (in phantom). Thigh section 48 is pivotable about axis 58 between a raised position angling upwardly from seat section 46 and a lowered position laying generally horizontally against frame 40. Thus, head section 44 and thigh section 48 are movable sections of patient-support deck 42.

Foot section 50 automatically moves when thigh section 48 moves. Foot end 34 of foot section 50 is coupled to frame 40 by a holding assembly 62 coupled to a pair of spaced-apart flanges 66 extending upwardly from frame 40, as shown in FIG. 1. A caregiver can manually move foot section 50 to a desired position when thigh section 48 is stationary and can use holding assembly 62 to hold foot section 50 at the desired position.

Figure 5:
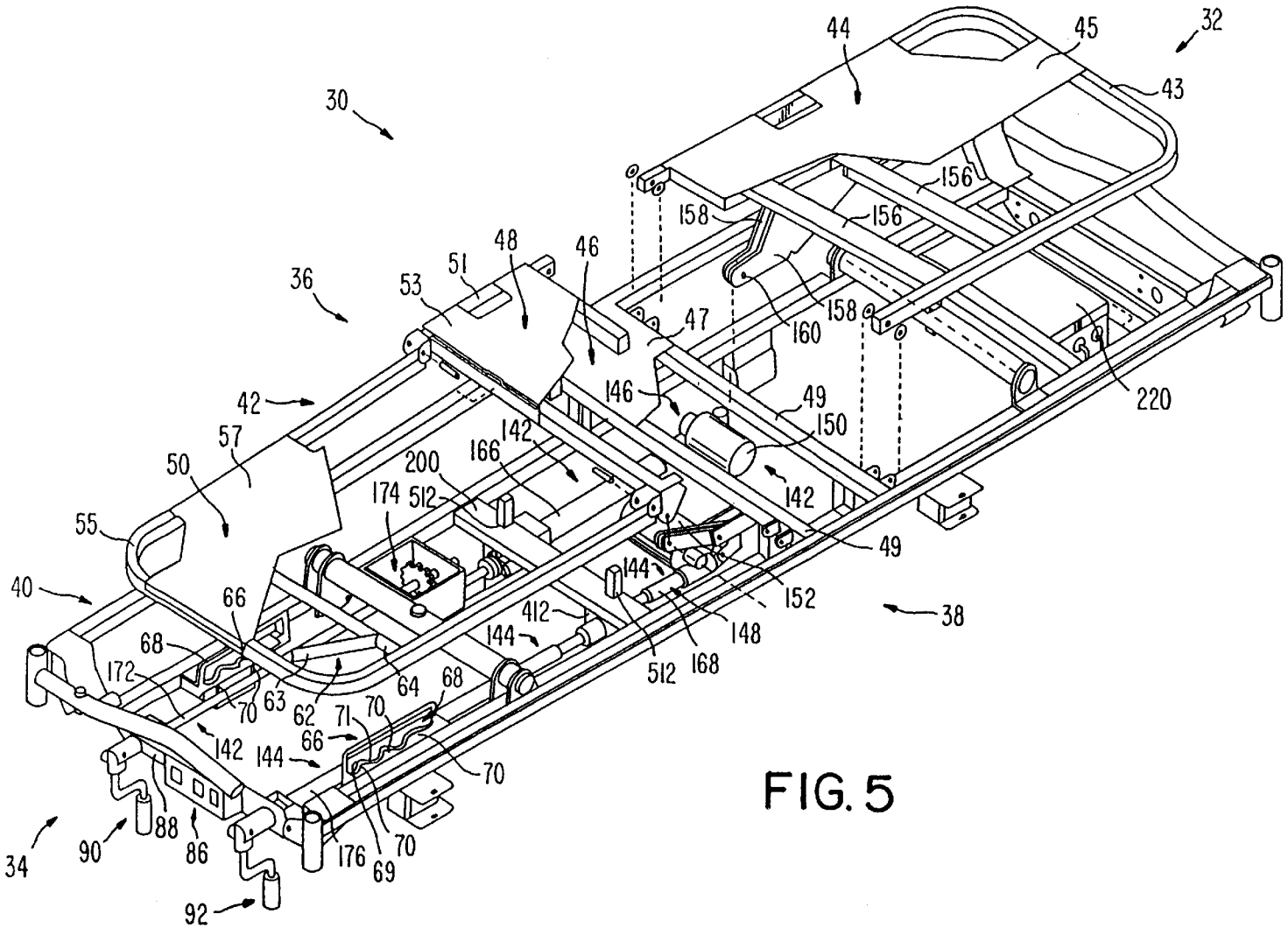
FIG. 5 is an exploded view of the frame and patient-support deck of the stretcher of FIG. 1 with portions broken away showing a head section actuator connected to the head section and connected to the frame, a thigh section actuator connected to the thigh section and connected to the frame, and the head and thigh section hand cranks coupled to respective head and thigh section actuators.

Holding assembly 62 includes a transversely-extending rod 64 that is pivotably connected to foot section 50 by a pair of links 63, as shown best in FIG. 5. First and second flanges 66 are connected to frame 40 and each flange 66 is formed to include several upwardly-extending retaining teeth 70 that define a serrated slot 68. Each tooth 70 includes an upstanding retaining edge 69 and a ramp 71. After manually moving foot section 50 to the desired position, the caregiver pivots rod 64 into contact with retaining edges 69 of selected teeth 70. Retaining edges 69 retain rod 64 so that rod 64 is held stationary relative to frame 40 and operates as a strut supporting foot section 50 in the desired position.

Stretcher 30 includes casters 72 mounted to frame 40 as shown in FIG. 1. Casters 72 engage a floor 73 so that the caregiver can move stretcher 30 across floor 73. In addition, stretcher 30 includes push handles 74 that a caregiver can grasp to push stretcher 30. Head, thigh, and foot sections 44, 48, 50 can be moved relative to frame 40 so that the patient can be transported by stretcher 30 in a reclined position, a supine position, or any position therebetween. Stretcher 30 also includes a plurality of foot pedals 76 that extend outwardly from underneath a shroud 77 that is positioned to lie underneath frame 40. Foot pedals 76 can be used to tilt frame 40 between a Trendelenburg position and a reverse Trendelenburg position, to raise and lower frame 40 relative to floor 73, and to brake casters 72 preventing stretcher 30 from inadvertently rolling along floor 73.

Figure 27:
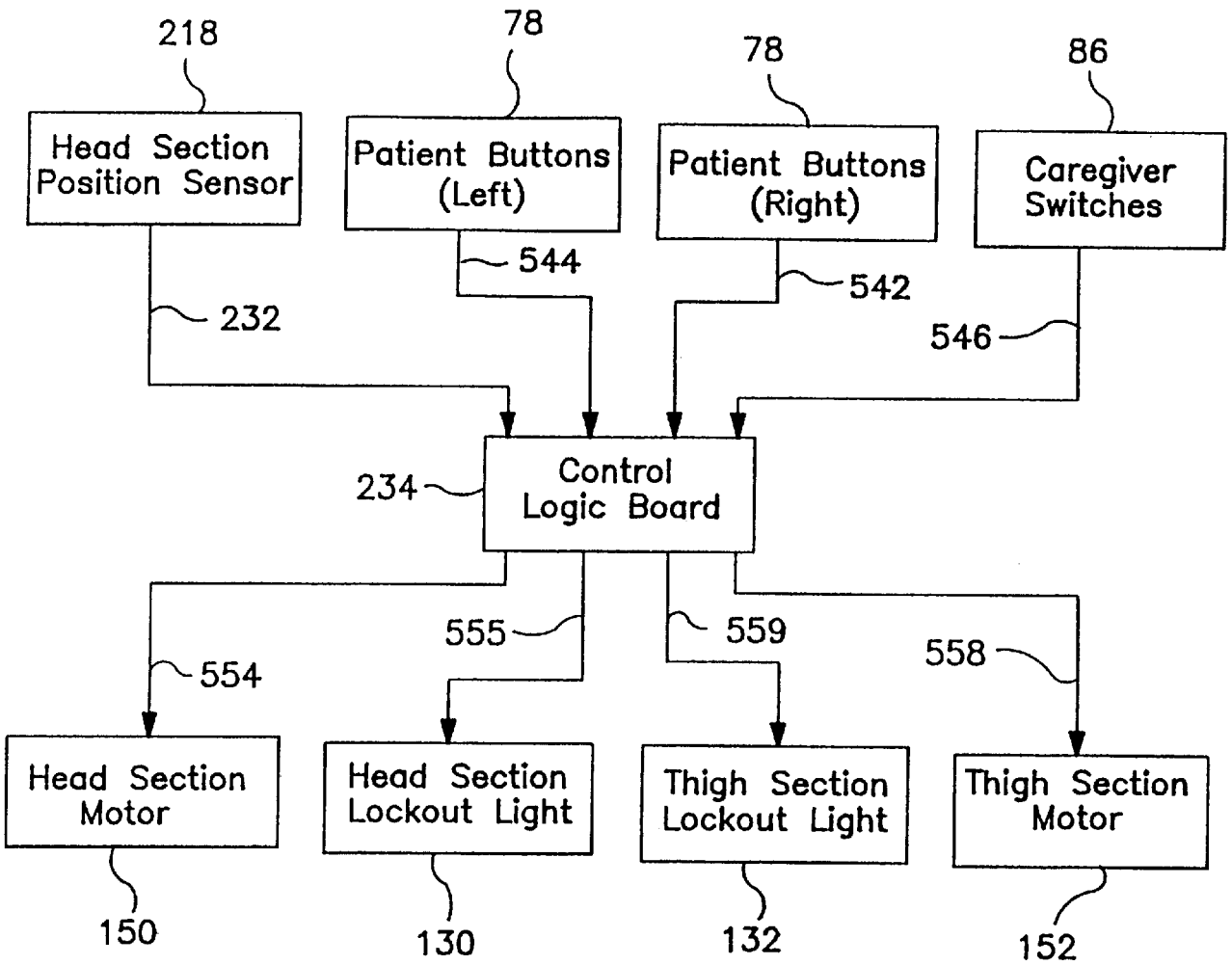
FIG. 27 is a block diagram of an electrical system of the stretcher of FIG. 1 showing a control logic board receiving patient input signals from left and right patient control buttons, a caregiver input signal from the caregiver control switches, and a position input signal from a head section position sensor and the control logic board providing a first output signal to the head section motor and a second output signal to the thigh section motor in response to the patient input signals, the caregiver input signal, and the position input signal.

Stretcher 30 includes control system 208, shown schematically in FIG. 27, having patient control buttons 78 mounted to a first side guard rail 80 adjacent to first side 36 of stretcher 30 and to a second side guard rail 82 adjacent to second side 38 of stretcher 30, as shown in FIG. 1. The patient can press selected patient control buttons 78 while resting on patient-support surface 54 to control the position of thigh section 48 and to control the position of head section 44. However, head section 44 cannot be raised toward the raised position past the intermediate position in response to the patient pressing control buttons 78.

Figure 2:
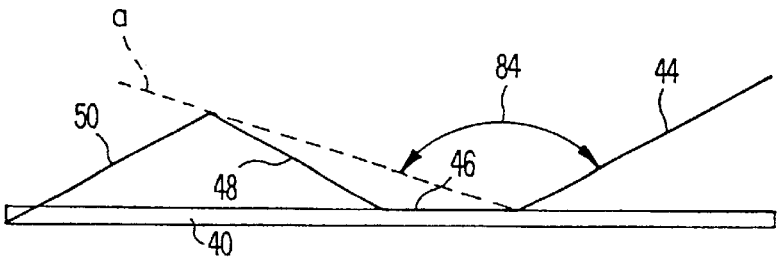
FIG. 2 is a diagrammatic view of the frame and patient-support deck of FIG. 1 showing a back-to-thigh angle defined as the angle between the head section and a plane extending from an axis where the head and seat sections are joined to an axis where the thigh and foot sections are joined.

Patient-support surface 54 of head section 44 cooperates with a plane a that extends through first pivot axis 56 and third pivot axis 58 to define a back-to-thigh angle 84 as shown in FIG. 2. Control system 208 is configured so that once back-to-thigh angle 84 reaches a predetermined minimum angle, patient control buttons 78 cannot be used to move head and thigh sections 44, 48 to a position where back-to-thigh angle 84 is less than the predetermined minimum angle. Thus, patient control buttons 78 can be used to move head and thigh sections 44, 48 to a desired position within only a limited range of motion. The predetermined minimum angle for stretcher 30 is approximately ninety degrees (90°) which is in compliance with International Electrotechnical Commission voluntary standard 601-2-38.

Figure 4:
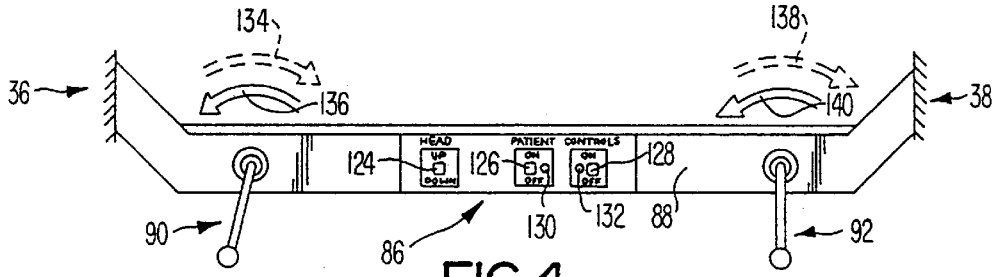
FIG. 4 is an end view of the frame of the stretcher of FIG. 1 showing the caregiver control switches, the head section hand crank being rotated clockwise to raise the head section, and the thigh section hand crank being rotated clockwise to raise the thigh section.

Stretcher 30 also includes caregiver control switches 86 that are centrally mounted to a transversely-extending frame member 88 of frame 40 at foot end 34 of stretcher 30 below patient-support deck 42, as shown in FIGS. 1 and 4. The caregiver can access caregiver control switches 86 which are generally inaccessible to the patient. The caregiver can use caregiver control switches 86 to move head section 44 between the raised and lowered positions and, if desired by the caregiver, head section 44 can be moved to a position having back-to-thigh angle 84 less than the predetermined minimum angle.

Although stretcher 30 includes patient control buttons 78 and caregiver control switches 86, it is within the scope of the invention as presently perceived for stretcher 30 to have other types of controls instead. For example, buttons 78 and switches 86 could be buttons, switches, levers, knobs, or any other type of controls capable of receiving a user input from a patient or a caregiver and providing an input signal used by control system 208 in response to the user input.

A head section hand crank 90 is pivotably mounted to frame member 88 at foot end 34 of stretcher 30 adjacent to first side 36 of stretcher 30 as shown in FIG. 1. A thigh section hand crank 92 is pivotably mounted to frame member 88 at foot end 34 of stretcher 30 adjacent to second side 38 of stretcher 30. Each of hand cranks 90, 92 can be moved between a storage position shown in FIG. 5 and a use position shown in FIGS. 4 and 6. The caregiver can access head and thigh section hand cranks 90, 92 while standing at foot end 34 of stretcher 30. Hand cranks 90, 92 are generally inaccessible by the patient.

When hand crank 90 is in the use position, the caregiver can manually rotate hand crank 90 to raise and lower head section 44 between the raised and lowered positions. In addition, when hand crank 92 is in the use position, the caregiver can manually rotate hand crank 92 to raise and lower thigh section 48 between the raised and lowered positions.

Stretcher 30 also includes first and second CPR release handles 94, each handle 94 being mounted to one of side guard rails 80, 82 below patient-support deck 42 so that first CPR release handle 94 is mounted adjacent to first side 36 of stretcher 30 as shown in FIG. 1 and second CPR release handle 94 is mounted adjacent to second side 38 of stretcher 30. Each CPR release handle 94 is yieldably biased toward a locking position but either handle 94 can be actuated by moving handle 94 from the locking position to a releasing position. Head section 44 will lower to the lowered position laying generally horizontally against a transversely-extending strut 95 of frame 40 in response to movement of either handle 94 to the releasing position. When either handle 94 is moved from the locking position to the releasing position, head section 44 lowers to the lowered position more quickly than if patient control buttons 78, caregiver control switches 86, or head section hand crank 90 are used to lower head section 44.

Figure 3:
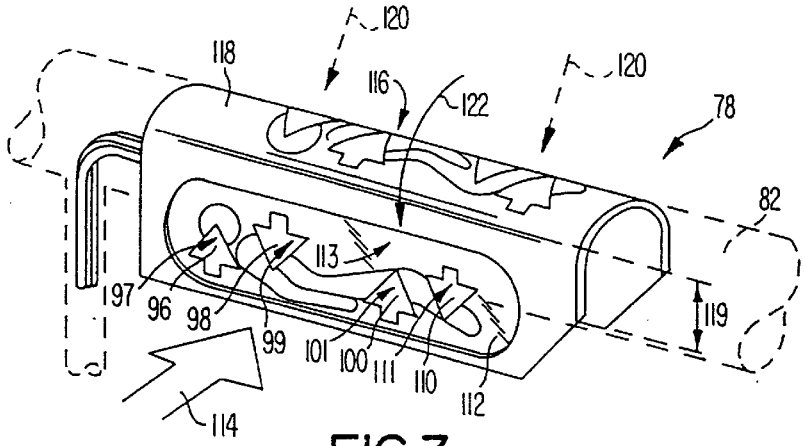
FIG. 3 is a perspective view of the patient control buttons of the stretcher of FIG. 1 including buttons mounted on a generally vertical surface of the side guard rail and including upwardly-facing indicia mounted on a generally horizontal surface of the guard rail.

As previously described, stretcher 30 includes control system 208 having patient control buttons 78 that a patient can press to control the position of the head and thigh sections 44, 48 through a limited range of motion. Patient control buttons 78 include a head-up button 96, a head-down button 98, a knee-up button 100, and a knee-down button 110 each of which is mounted on a generally vertical surface 112 of second guard rail 82 as shown in FIG. 3 and a head-up button 96, a head-down button 98, a knee-up button 100, and a knee-down button 110 each of which is mounted on a generally vertical surface 112 of first guard rail 80 as shown in FIG. 1.

Buttons 96, 98, 100, 110 face inwardly toward mattress 52 allowing the patient to easily access buttons 96, 98, 100, 110 from mattress 52 as shown by arrow 114. Each button 96, 98, 100, 110 includes an engagement surface 97, 99, 101, 111, respectively, that is engaged by the patient or the caregiver to actuate buttons 96, 98, 100, 110. Engagement surfaces 97, 99, 101, 111 of adjacent buttons 96, 98, 100, 110 are generally coplanar and cooperate with one another to define a continuous unitary surface 113 as shown, for example, in FIG. 3. Having surfaces 97, 99, 101, 111 define continuous unitary surface 113 maximizes the ability of the caregiver to clean and successfully sterilize surfaces 97, 99, 101, 111.

Head section 44 pivots upwardly about axis 56 when either of buttons 96 are pressed and head section 44 pivots downwardly about axis 56 when either of buttons 98 are pressed. Similarly, thigh section 48 pivots upwardly about axis 58 when either of buttons 100 are pressed and thigh section 48 pivots downwardly about axis 58 when either of buttons 110 are pressed.

Stretcher 30 also includes upwardly-facing indicia 116 located on a generally horizontal surface 118 on top of each guard rail 80, 82. A caregiver standing at first side 36 or second side 38 of stretcher 30 can view indicia 116 from a direction indicated by arrows 120, as shown in FIG. 3 (in phantom), and can access buttons 96, 98, 100, 110 from outside of stretcher 30 as indicated by arrow 122. Each button 96, 98, 100, 110 is spaced apart from top surface 118 by a distance 119 so that buttons 96, 98, 100, 110 are easily accessed using the thumb of the caregiver when the caregiver stands outside of stretcher 30 and rests their hand on top surface 118. Thus, buttons 96, 98, 100, 110 are conveniently placed and indicia 116 indicates the function of each of buttons 96, 98, 100, 110 to the caregiver allowing the caregiver to easily select and press a desired button without leaning over first or second side guard rails 80, 82.

Control system 208 also includes caregiver control switches 86 at foot end 34 of stretcher 30 as shown in FIG. 4. Switches 86 include a head up-down switch 124, a head section lockout switch 126, and a thigh section lockout switch 128. Switch 124 is a three position switch that is normally in a middle neutral position. When the caregiver moves switch 124 to a head-up position, head section 44 raises and when the caregiver moves switch 124 to a head-down position, head section 44 lowers.

Head section lockout switch 126, shown in FIG. 4, is a two position switch that is switchable between an on position and an off position. When lockout switch 126 is in the on position, buttons 96, 98 and switch 124 are "locked out" or "disabled" so that head section 44 does not move when buttons 96, 98 are pressed or when switch 124 is moved to either the head-up position or the head-down position. When lockout switch 126 is in the off position, buttons 96, 98 and switch 124 are "enabled" so that head section 44 moves when buttons 96, 98 are pressed or when switch 124 is moved to either the head-up position or the head-down position. Similarly, thigh section lockout switch 128 is a two position switch that is switchable between an on position disabling buttons 100, 110 so that thigh section 48 does not move when buttons 100, 110 are pressed and an off position enabling buttons 100, 110 so that thigh section 48 moves when buttons 100, 110 are pressed. Thus, when buttons 96, 98 and switch 124 are disabled, the patient cannot move head section 44 and the caregiver cannot move head section 44 by use of switch 124 and when buttons 100, 110 are disabled, the patient cannot move thigh section 48. A light 130 is located adjacent to head section lockout switch 126 and light 130 is lit when buttons 96, 98 are enabled. A light 132 is located adjacent to thigh section lockout switch 128 and light 132 is lit when buttons 100, 110 are enabled.

As previously described, the caregiver can manually rotate head section hand crank 90 and thigh section hand crank 92 to move head and thigh sections 44, 48, respectively. Head section 44 raises when the caregiver rotates head section hand crank 90 in a clockwise direction indicated by arrow 134 (in phantom) and head section 44 lowers when the caregiver rotates head section hand crank 90 in a counterclockwise direction indicated by arrow 136, as shown in FIG. 4. Thigh section 48 raises when the caregiver rotates thigh section hand crank 92 in a clockwise direction indicated by arrow 138 (in phantom) and thigh section 48 lowers when the caregiver rotates thigh section hand crank in a counterclockwise direction indicated by arrow 140. Thus, head section hand crank 90 and thigh section hand crank 92 rotate in the same direction to raise and to lower respective head and thigh sections 44, 48.

Stretcher 30 includes a head section drive mechanism 142 extending longitudinally from head section 44 to head section hand crank 90 adjacent to first side 36 of stretcher 30 as shown in FIGS. 5 and 6. Drive mechanism 142 is connected to head section 44 and to frame 40 so that actuation of drive mechanism 142 moves head section 44 relative to frame 40. Stretcher 30 also includes a thigh section drive mechanism 144 extending longitudinally from thigh section 48 to thigh section hand crank 92 adjacent to second side 38 of stretcher 30. Drive mechanism 144 is connected to thigh section 48 and to frame 40 so that actuation of drive mechanism 144 moves thigh section 48.

Head section drive mechanism 142 includes a head section motor 150 coupled to head section 44 and a head section actuator 146 coupled to motor 150 and coupled to hand crank 90 as shown in FIGS. 5–8. Actuator 146 includes a head section drive tube 164 extending from motor 150 toward foot end 34 of stretcher 30 and a tubular housing 166 mounted to frame 40 and coupled to drive tube 164. Thigh section drive mechanism 144 includes a thigh section motor 152 coupled to thigh section 48 and a thigh section actuator 148 coupled to motor 152 and coupled to hand crank 92 a shown in FIGS. 5, 6, 9, and 10. Actuator 148 includes a tubular housing 168 extending from motor 152 toward foot end 34 of stretcher 30 and a thigh section drive tube 170 mounted to frame 40 and coupled to tubular housing 168.

Actuator 146 of stretcher 30 is a model number 566265 actuator manufactured by SKF Specialty Products Co. located in Bethlehem, Pa. Actuator 146 can be manually cranked and mechanically driven such that the maximum torque on actuator 146 is approximately one hundred inch-pounds (100 in-lbs, 0.0293 N-m) to raise approximately two hundred twenty five pounds (225 lbs, 102 kg) placed on the middle of head section 44. In addition, actuator 146 has a backdrive feature allowing the actuator to collapse by a force not exceeding fifteen pounds (15 lbs, 6.8 kg). However, any linear actuator that can be made to perform in a manner similar to actuator 146 can be used without exceeding the scope of the invention as presently perceived.

Actuator 148 of stretcher 30 is a model number 566267 actuator also manufactured by SKF Specialty Products Co. located in Bethlehem, Pa. Actuator 148 can be manually cranked and mechanically driven such that the maximum torque on actuator 148 is approximately one hundred inch-pounds (100 in-lbs, 0.0293 N-m) to raise approximately one hundred fifty pounds (150 lbs, 68 kg) placed on the middle of thigh section 48. However, any linear actuator that can be made to perform in a manner similar to actuator 148 can be used without exceeding the scope of the invention as presently perceived. In addition, motor 150 of stretcher 30 is a model number 1842420019 motor manufactured by Reliance Electric of Gallipolis, Ohio and motor 152 is a model number 1842420017 motor manufactured by Reliance Electric of Gallipolis, Ohio.

Figure 7:
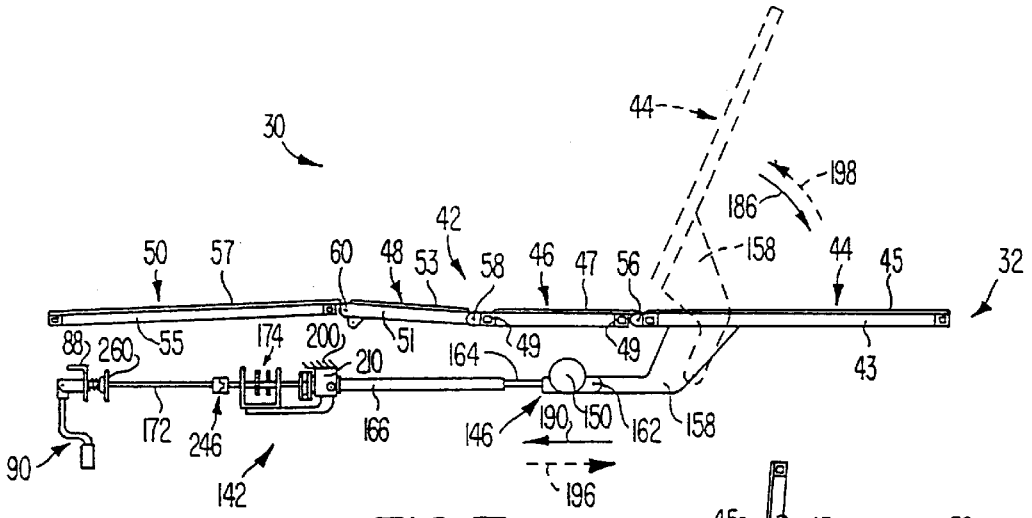
FIG. 7 is a diagrammatic view of the patient-support deck of the stretcher of FIG. 6 and the mechanism for moving the head section showing the head section actuator retracted and the head section in a corresponding lowered position.

When head section 44 is in the lowered position, drive tube 164 is telescopically retracted into tubular housing 166 so that actuator 146 is in a retracted configuration shown in FIG. 7. When drive mechanism 142 is actuated to move head section 44 from the lowered position toward the raised position, drive tube 164 telescopically extends out of tubular housing 166 pushing head section 44 upwardly toward the raised position. When head section 44 is at the raised position, actuator 146 is in an extended configuration shown in FIG. 8.

Figure 9:
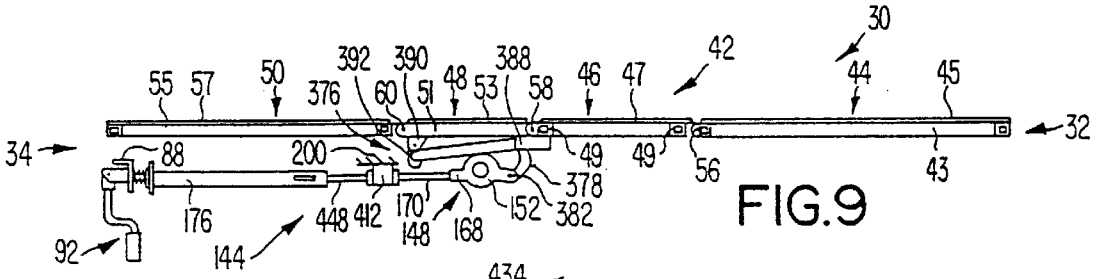
FIG. 9 is a diagrammatic view of the patient-support deck of the stretcher of FIG. 6 and the mechanism for moving the thigh section showing the thigh section actuator extended and the thigh section in a corresponding lowered position.

When thigh section 48 is in the lowered position, drive tube 170 extends out of tubular housing 168 so that actuator 148 is in an extended configuration shown in FIG. 9. When drive mechanism 144 is actuated to move thigh section 48 from the lowered position toward the raised position, drive tube 170 telescopically retracts into tubular housing 168 pulling thigh section 48 upwardly toward the raised position. When thigh section 48 is at the raised position, actuator 148 is in a retracted configuration shown in FIG. 10.

When stretcher 30 is generally stationary, a power plug 154, shown in FIG. 6, can be plugged into a conventional power outlet (not shown) supplying power to stretcher 30 so that motor 150 can be operated to retract and extend drive tube 164 relative to tubular housing 166 thereby moving head section 44 and so that motor 152 can be operated to retract and extend drive tube 170 relative to tubular housing 168 thereby moving thigh section 48. Buttons 96, 98 of patient control buttons 78 and switch 124 of caregiver control switches 86 are coupled to head section motor 150 and cooperate with the rest of control system 208 to control the operation of motor 150. Similarly, buttons 100, 110 of patient control buttons 78 are coupled to thigh section motor 152 and cooperate with the rest of control system 208 to control the operation of motor 152.

Drive mechanism 142 includes a gear box 174 and a head section crank shaft 172 coupling hand crank 90 to gear box 174 as shown in FIGS. 5 and 6. Head section actuator 146 is also coupled to gear box 174 so that when stretcher 30 is away from a power outlet and gears 238, 244 mesh, the caregiver can manually rotate hand crank 90 and crank shaft 172 and manually actuate head section actuator 146 to move head section 44. Similarly, drive mechanism 144 includes a thigh section crank shaft 176 extending from hand crank 92 to thigh section actuator 148. The caregiver can manually rotate hand crank 92 and crank shaft 176 to manually actuate thigh section actuator 148 and move thigh section 48.

Thus, head section drive mechanism 142 includes motor 150 that can be activated by pressing buttons 96, 98 and switch 124 to provide a mechanized drive for automatically moving head section 44. Head section drive mechanism 142 also includes crank shaft 172 that cooperates with gear box 174 and actuator 146 to provide a hand-operated drive for manually moving head section 44. Similarly, thigh section drive mechanism 144 includes motor 152 that can be activated by pressing buttons 100, 110 to provide a mechanized drive for automatically moving thigh section 48. Thigh section drive mechanism 144 also includes crank shaft 176 that cooperates with actuator 148 to provide a hand-operated drive 162 for manually moving thigh section 48.

It is well known in the hospital bed art that electric drive motors with various types of transmission elements including lead screw drives and various types of mechanical linkages may be used to cause relative movement of portions of hospital beds and stretchers. As a result, the term "mechanized drive" in the specification and in the claims is intended to cover all types of machine powered drivers including mechanical, electromechanical, hydraulic, and pneumatic drivers that can extend and retract to raise and lower movable sections of patient-support deck 42 and including combinations thereof such as hydraulic cylinders in combination with electromechanical pumps for pressurizing fluid received by the hydraulic cylinders. Likewise, the term "hand-operated drive" is intended to cover all types of manually powered drivers including manual cranking mechanisms of all types.

Figure 10:
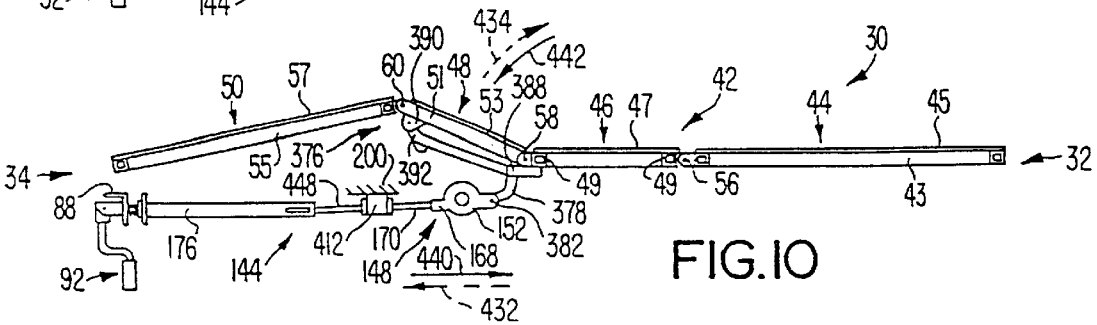
FIG. 10 is a view similar to FIG. 9 showing the thigh section actuator retracted and the thigh section moved to a raised position in response to the retraction of the thigh section actuator.
Figure 11:
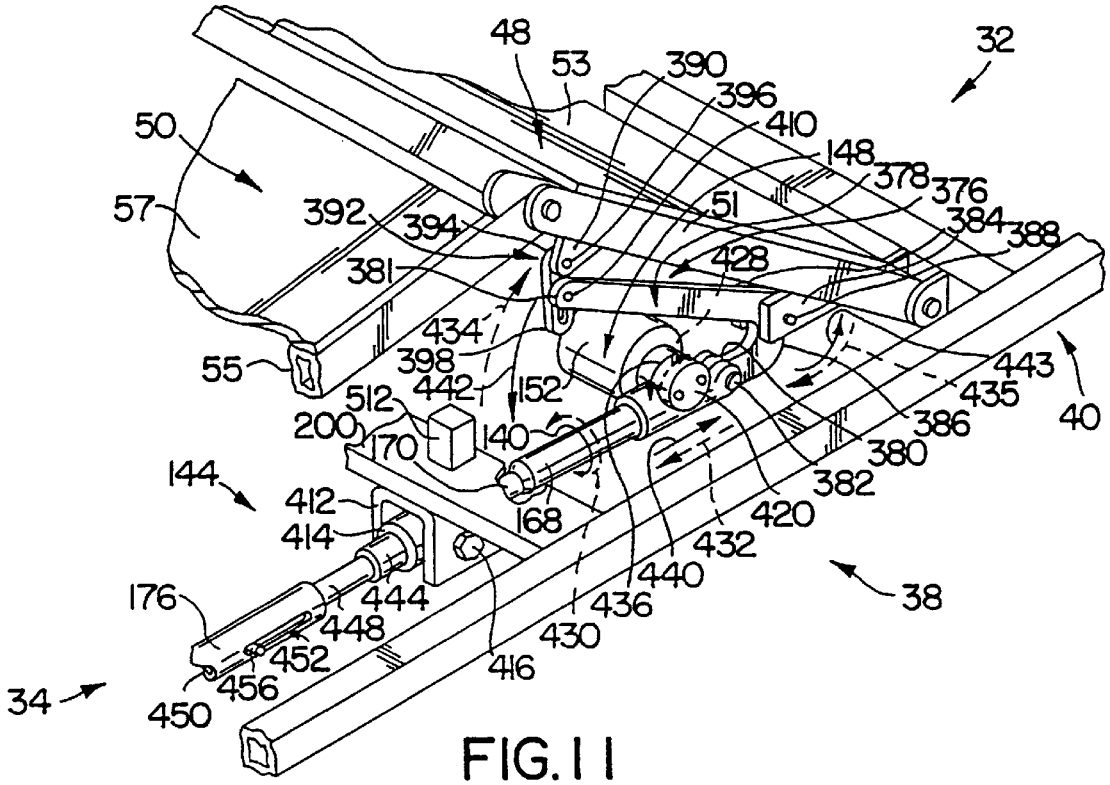
FIG. 11 is a perspective view of the thigh section and thigh section actuator of the stretcher of FIG. 10 with portions broken away showing a thigh section motor connected to the thigh section and connected to the thigh section actuator, the motor operating to retract and extend the thigh section actuator to raise and lower the thigh section.

Stretcher 30 includes a thigh section linkage 376 that couples actuator 148 of drive mechanism 144 to thigh section 48, as shown in FIGS. 9–12. Linkage 376 includes a curved cane-shaped link 378 positioned to lie below thigh section 48 and above actuator 148. Curved link 378 includes a first end 380 pivotably coupled to head end 32 of actuator 148 by a pivot pin 382. A pair of mounting flanges 384 are mounted to one of transverse members 49 of frame 40 and extend toward foot end 34 of stretcher 30. An elbow portion 386 of curved link 378 is pivotably coupled to flanges 384 by a pivot pin 388 as shown in FIG. 11.

Figure 12:
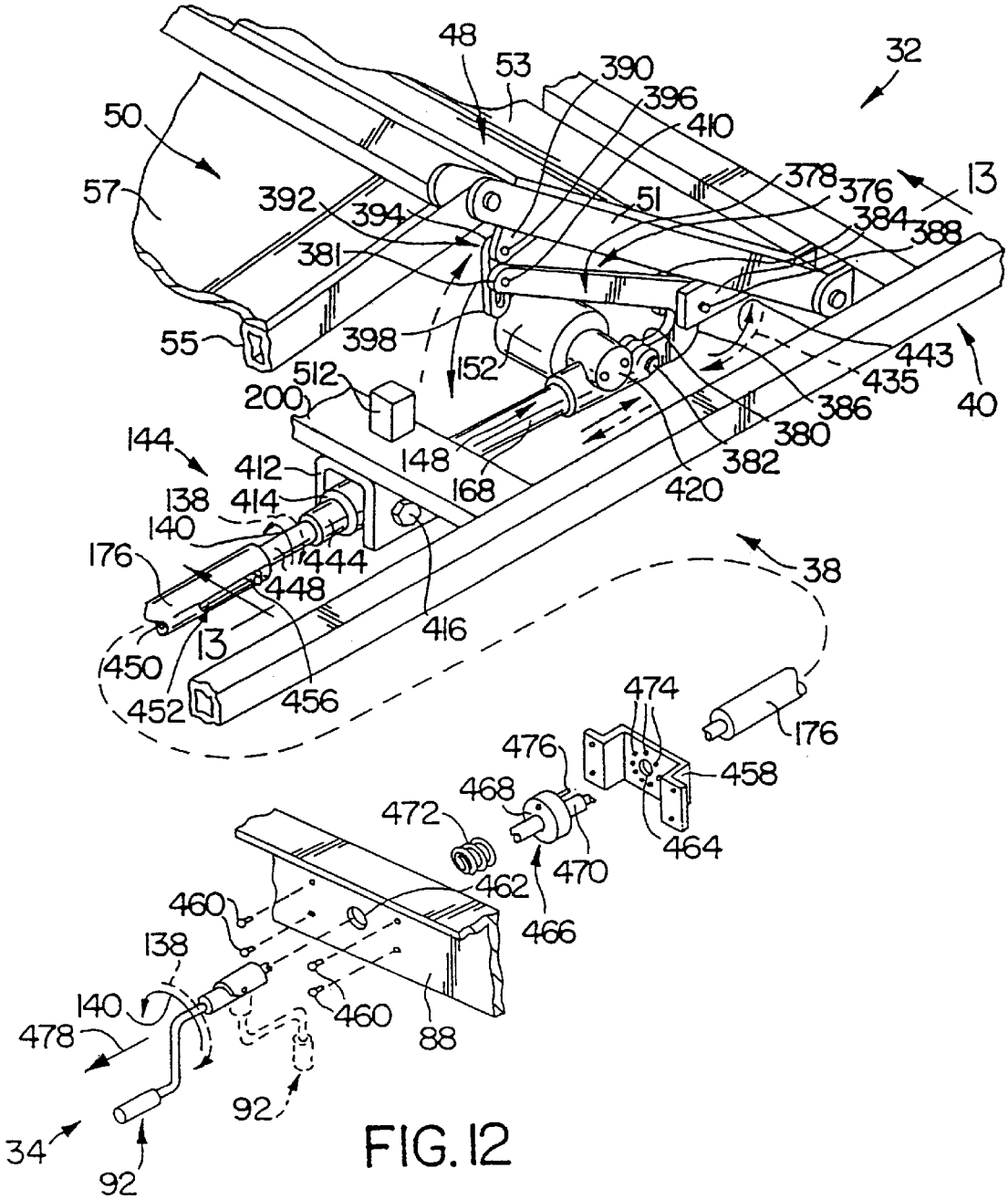
FIG. 12 is an exploded perspective view of the thigh section and thigh section actuator of the stretcher of FIG. 11 showing the thigh section hand crank and thigh section crank shaft moved axially rearwardly to a rearwardmost position so that the thigh section crank shaft can be manually rotated, the thigh section crank shaft being formed to include a slot receiving a coupling pin so that rotation of the thigh section crank shaft rotates a drive tube of the thigh section actuator to extend and retract the thigh section actuator and raise and lower the thigh section.

Thigh section 48 includes a downwardly-extending flange 390 and linkage 376 includes a slotted link 392 having an upper end 394 pivotably coupled to flange 390 by a pivot pin 396 as shown in FIGS. 11 and 12. A lower end 398 of link 392 is formed to include a slot 400 and a second end 381 of curved link 378 is coupled to slotted link 382 by a pin 410 that is received by slot 400 for pivoting and sliding movement therein. When actuator 148 moves between the extended configuration of FIG. 9 and the retracted configuration of FIG. 10, linkage 376 pivots about pin 388 resulting in pivoting movement of thigh section 48 between the lowered and raised positions.

Figure 13:
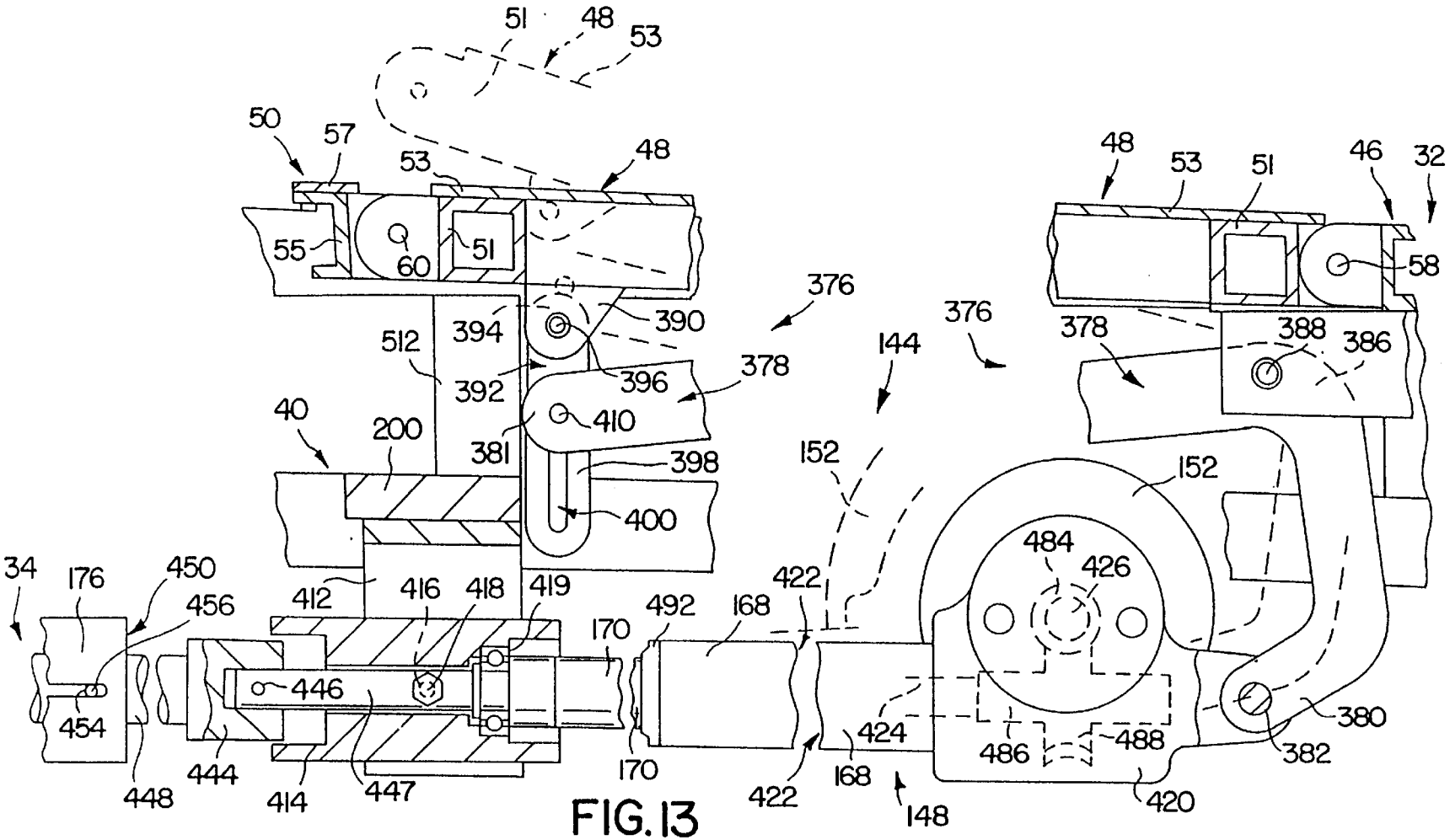
FIG. 13 is a side elevation view of the thigh section actuator of FIG. 12 with portions broken away showing a gear reducer coupling an output shaft of the thigh section motor to the thigh section actuator, a sleeve coupling the thigh section actuator to the frame, and the thigh section actuator being coupled to the thigh section crank shaft.

Frame 40 includes a transversely-extending frame member 200 positioned to lie underneath foot section 50, as shown in FIGS. 1 and 5–13. A mounting bracket 412 is attached to frame member 200 and extends downwardly therefrom, as shown in FIGS. 5, 11, and 13. Drive mechanism 144 includes a sleeve 414 that is mounted to mounting bracket 412 by a pair of pivot bolts 416 so that sleeve 414 can pivot about a transversely-extending pivot axis 418. A bearing 419 couples drive tube 170, which moves axially relative to housing 166 when actuator 148 extends and retracts, to sleeve 414 as shown in FIG. 13. Bearing 419 allows drive tube 170 to rotate relative to sleeve 414 but prevents axial movement of tube 170 relative to sleeve 414. Thus, drive mechanism 144 is coupled to thigh section 48 by linkage 376 and drive mechanism 144 is coupled to frame 40 by bolts 416 and mounting bracket 412.

Drive tube 170 and tubular housing 168 are telescoping members and are maintained in a generally in-line orientation during axial movement of tube 170 relative to housing 168 as shown, for example, in FIGS. 9 and 10. However, axial movement of tube 170 relative to housing 168 acts on linkage 376 to move pivot pin 382 that connects actuator 148 to curved link 378 in an arc about pivot pin 388 so that as thigh section 48 moves between the raised and lowered positions, actuator 148 tilts slightly relative to frame 40 about pivot axis 418.

Actuator 148 includes a gear reducer 420 coupled to an output shaft 426 of motor 152 as shown in FIGS. 11–13. Tubular housing 168 is fixed to gear reducer 420 and extends from gear reducer 420 toward foot end 34 of stretcher 30. In addition, drive tube 170 is coaxially received within an interior region 422 of housing 168. A drive shaft 424 is coupled to drive tube 170 so that rotation of drive shaft 424 relative to frame 40 causes drive tube 170 to move axially relative to housing 168.

When power plug 154 receives power from a power outlet, thigh section 48 is at any position between the raised and lowered positions, and either the caregiver or the patient presses knee-up button 100 while button 100 is not disabled by lockout switch 128, output shaft 426 of motor 152 rotates in a direction indicated by arrow 436 as shown in FIG. 11. Rotation of output shaft 426 in direction 436 operates through gear reducer 420 to rotate drive shaft 424 and drive tube 170 relative to tubular housing 168 in a direction indicated by arrow 430 (in phantom). When drive shaft 424 rotates in direction 430, drive tube 170 retracts into interior region 422.

Movement of drive tube 170 retracting into interior region 422 of housing 168 pulls pin 382 in direction 432 and pivots curved link 378 about pivot pin 388 in a direction indicated by arrow 435 (in phantom), thus moving second end 381 of link 378 upwardly as shown in FIGS. 9–11. Upward movement of second end 381 of link 378 pushes slotted link 392 upwardly thus pushing foot end 34 of thigh section 48 upwardly to pivot thigh section 48 about pivot axis 58 in an upward direction indicated by arrow 434 (in phantom) toward the raised position.

When power plug 154 receives power from a power outlet, thigh section 48 is at any position between the raised and lowered positions, and either the caregiver or the patient presses knee-down button 110 while button 110 is not disabled by lockout switch 128, output shaft 426 of motor 152 rotates in a direction indicated by arrow 428 as shown in FIG. 11. Rotation of output shaft 426 in direction 428 operates through gear reducer 420 to rotate drive shaft 424 relative to both tubular housing 168 and drive tube 170 in a direction indicated by arrow 438. When drive shaft 424 rotates in direction 438, drive tube 170 extends out of interior region 422.

Movement of drive tube 170 extending out of housing 168 pushes pin 382 in direction 440 and pivots curved link 378 about pivot pin 388 in a direction indicated by arrow 443 thus moving second end 381 of link 378 downwardly as shown in FIGS. 9–11. Downward movement of second end 381 of link 378 pulls slotted link 392 downwardly thus pulling foot end 34 of thigh section 48 downwardly to pivot thigh section 48 about pivot axis 58 in a downward direction indicated by arrow 442 toward the lowered position. Thus, button 100 can be pressed to actuate actuator 148 so that the mechanized drive automatically raises thigh section 48 and button 110 can be used to actuate actuator 148 so that the mechanized drive automatically lowers thigh section 48 when power plug 154 receives power from a power outlet and buttons 100, 110 are not disabled by lockout switch 128.

Drive mechanism 144 includes a connector shaft 447 fixed to drive tube 170 and a U-joint sleeve 444 connected to connector shaft 447 by a pivot pin 446 as shown in FIG. 13. Drive mechanism 144 also includes a connecting shaft 448 that is coupled to U-joint sleeve 444. Shaft 448 extends from sleeve 444 toward foot end 34 of stretcher 30 and is coupled to crank shaft 176 as shown in FIGS. 11 and 12. Crank shaft 176 is formed to include an interior region 450 and connecting shaft 448 extends into interior region 450. Crank shaft 176 is formed to include a pair of longitudinally-extending slots 452 and connecting shaft 448 is formed to include a pair of apertures 454 that align with slots 452. A coupling pin 456 is received by apertures 454 and slots 452 to couple crank shaft 176 to connecting shaft 448 as shown in FIGS. 11–13.

Stretcher 30 includes a stop bracket 458 mounted to frame member 88 of frame 40 by fasteners 460 as shown in FIG.

12. Frame member 88 is formed to include an aperture 462 and stop bracket 458 is formed to include an aperture 464 aligned with aperture 462. Crank shaft 176 is received by apertures 462, 464 for rotational and translational movement with respect to bracket 458 and frame member 88. A tubular bushing 466 having a radially outwardly-extending thrust portion 468 is fixed to crank shaft 176 to rotate and translate therewith. Bushing 466 is received by aperture 464 of stop bracket 458 with thrust portion 468 being positioned to lie between frame member 88 and stop bracket 458.

A compression spring 472 is mounted on crank shaft 176, as shown in FIG. 12, and is maintained in compression between frame member 88 and thrust portion 468 of bushing 466 so that thrust portion 468 and crank shaft 176 are yieldably biased toward head end 32 of stretcher 30 and against bracket 458. When thrust portion 468 of bushing 466 engages bracket 458, crank shaft 176 is in a forwardmost position having foot end 34 of each slot 452 adjacent to coupling pin 456 as shown in FIG. 11.

Stop bracket 458 is formed to include a plurality of circumferentially-spaced apertures 474 surrounding aperture 464 as shown in FIG. 12. A locking pin 476 is attached to thrust portion 468 of bushing 466 and extends therefrom toward head end 32 of stretcher 30. When thrust portion 468 engages stop bracket 458, pin 476 is received by one of apertures 474 to lock crank shaft 176 against rotation. Locking crank shaft 176 against rotation also locks drive tube 170 of actuator 148 against rotation since drive tube 170 is coupled to crank shaft 176 by U-joint sleeve 444, connecting shaft 448, and coupling pin 456.

When the caregiver pulls hand crank 92 axially rearwardly, as indicated by arrow 478 in FIG. 12, crank shaft 176 moves axially in direction 478. Movement of crank shaft 176 in direction 478 moves thrust portion 468 away from stop bracket 458 withdrawing locking pin 476 from the corresponding one of apertures 474 in which locking pin 476 was received. Movement of crank shaft 176 in direction 478 also further compresses spring 472 between thrust portion 468 and frame member 88. When spring 472 is fully compressed against frame member 88 limiting further rearward movement of thrust portion 468 and thus of hand crank 92, hand crank 92 and crank shaft 176 are in a rearwardmost position having head end 32 of each slot 452 adjacent to coupling pin 456 as shown in FIG. 12.

After the caregiver moves hand crank 92 to the rearwardmost position withdrawing locking pin 476 from the corresponding one of apertures 474 in which locking pin 476 was received, the caregiver can manually rotate hand crank 92 in direction 138 to rotate crank shaft 176 in direction 138 as shown in FIG. 12. Drive shaft 424 is held against rotation by output shaft 426 of motor 152 which is held against rotation by the friction within motor 152 when motor 152 is not activated. Thus, rotation of crank shaft 176 does not result in the rotation of drive shaft 424 or in the movement of unactivated motor 152. The caregiver can therefore manually raise thigh section 48 by pulling hand crank 92 in direction 478 to the rearwardmost position and then rotating hand crank 92 in direction 138. In addition, the caregiver can manually lower thigh section 48 by pulling hand crank 92 in direction 478 to the rearwardmost position and then rotating hand crank 92 in direction 140.

As previously described, thigh section actuator 148 includes gear reducer 420 mounted to motor 152. Gear reducer 420 includes a worm 484 that is fixed to output shaft 426 of motor 152, as shown in FIG. 13 (in phantom). Gear reducer 420 also includes a drive shaft 486 and a worm gear 488 mounted to drive shaft 486, as also shown in FIG. 13 (in phantom). Bearings (not shown) support drive shaft 486 within gear reducer 420. The bearings allow drive shaft 486 to rotate but hold drive shaft 486 against axial movement relative to motor 152. Worm gear 488 meshes with worm 484 so that rotation of output shaft 426 and worm 484 by motor 152 rotates worm gear 488 and drive shaft 486. Drive shaft 424 connects to drive shaft 486 so that drive shaft 424 rotates along with drive shaft 486 in response to rotation of output shaft 426 of motor 152.

If button 110 is pressed to lower thigh section 48 when thigh section 48 is in the lowered position but actuator 148 is not fully extended, motor 152 may rotate drive shaft 424 in direction 440 pivoting curved link 378 about pivot pin 388 so that pin 410 moves downwardly in slot 400 until thigh section actuator 148 is in a fully-extended configuration. Thus, slot 400 compensates for tolerance variations and allows linkage 378 to move when thigh section 48 is in the lowered position.

Actuator 148 includes a conventional slip clutch mechanism (not shown) inside gear reducer 482. The slip clutch mechanism couples worm gear 488 to drive shaft 486 so that gear 488 and shaft 486 rotate together when motor 152 is activated to move thigh section 48 between the raised and lowered positions. However, if button 110 is pressed when actuator 148 is in the fully extended configuration, drive shaft 424 is prevented from rotating and the slip clutch will operate to allow gear 488 to rotate relative to shaft 486. In addition, if the caregiver manually rotates hand crank 92 in direction 140 when actuator 148 is in the fully extended configuration, the slip clutch will operate to allow shaft 486, which is coupled to drive shaft 424, to rotate relative to gear 488, which is held against rotation by motor 152.

If button 100 is pressed when actuator 148 is in the fully retracted configuration, the slip clutch will operate to allow gear 488 to rotate relative to shaft 486. In addition, if the caregiver manually rotates hand crank 92 in direction 138 when actuator 148 is in the fully retracted configuration, the slip clutch will operate to allow shaft 486, which is coupled to drive shaft 424, to rotate relative to gear 488, which is held against rotation by motor 152.

Figure 8:
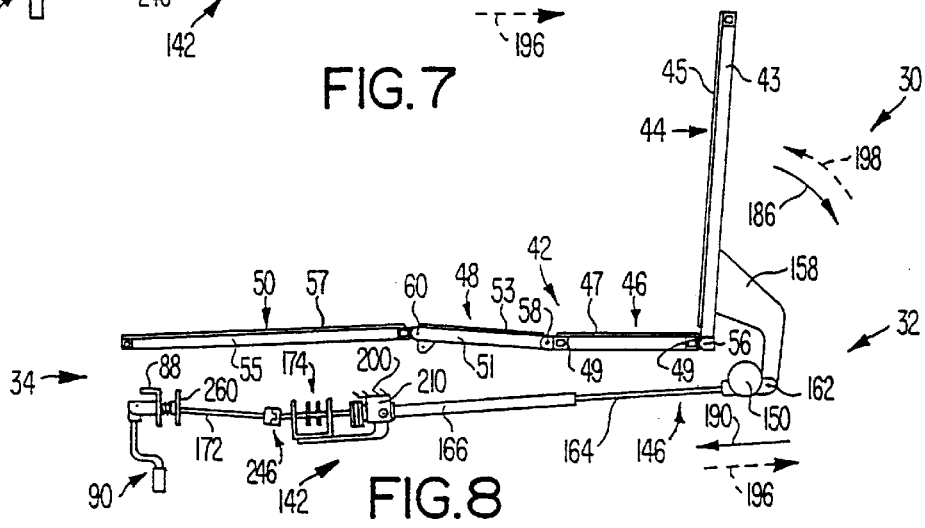
FIG. 8 is a view similar to FIG. 7 showing the head section actuator extended and the head section moved to a raised position in response to the extension of the head section actuator.
Figure 16:
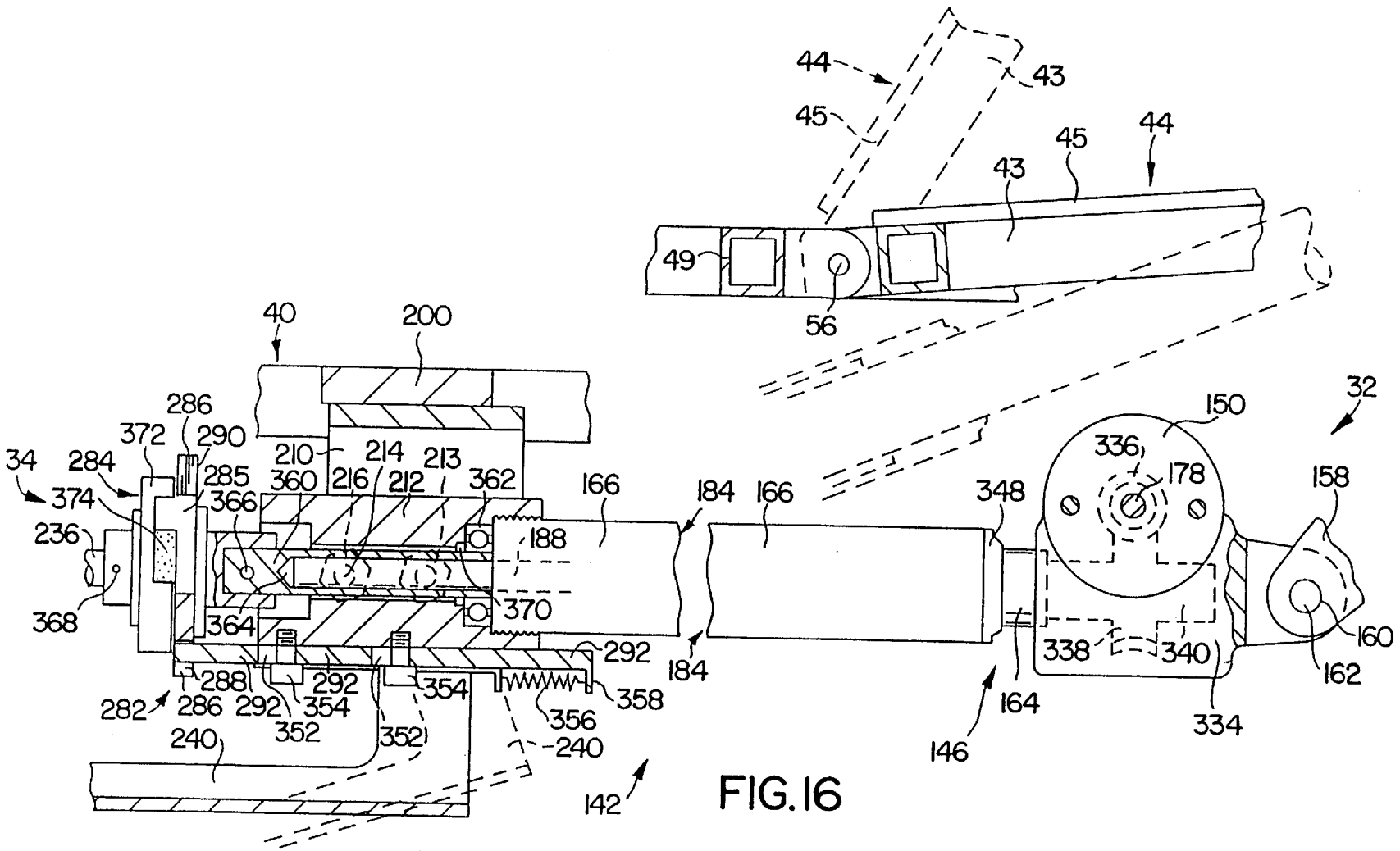
FIG. 16 is a side elevation view of the head section actuator of FIG. 15 with portions broken away showing a gear reducer coupling the output shaft of the head section motor to the head section actuator, a sleeve coupling the head section actuator to the frame, and the head section actuator being coupled to the CPR release mechanism.

As previously described, stretcher 30 includes head section drive mechanism 142 that can be actuated manually by hand crank 90 and automatically by buttons 96, 98 and switch 124 to move head section 44. Head section 44 includes a pair of spaced-apart transversely-extending frame members 156 beneath support panel 55 as shown best in FIG. 5. A pair of spaced-apart mounting flanges 158 are attached to frame members 156 and extend generally downwardly therefrom. Each mounting flange 158 is formed to include an aperture 160 and head end 32 of actuator 146 is pivotably coupled to mounting flanges 158 by a pivot pin 162 received by apertures (not shown) formed in actuator 146 and received by apertures 160 as shown in FIGS. 7, 8, and 16. When head section 44 moves between the raised and lowered positions, mounting flanges 158 pivot about pivot pin 162 relative to actuator 146.

Figure 14:
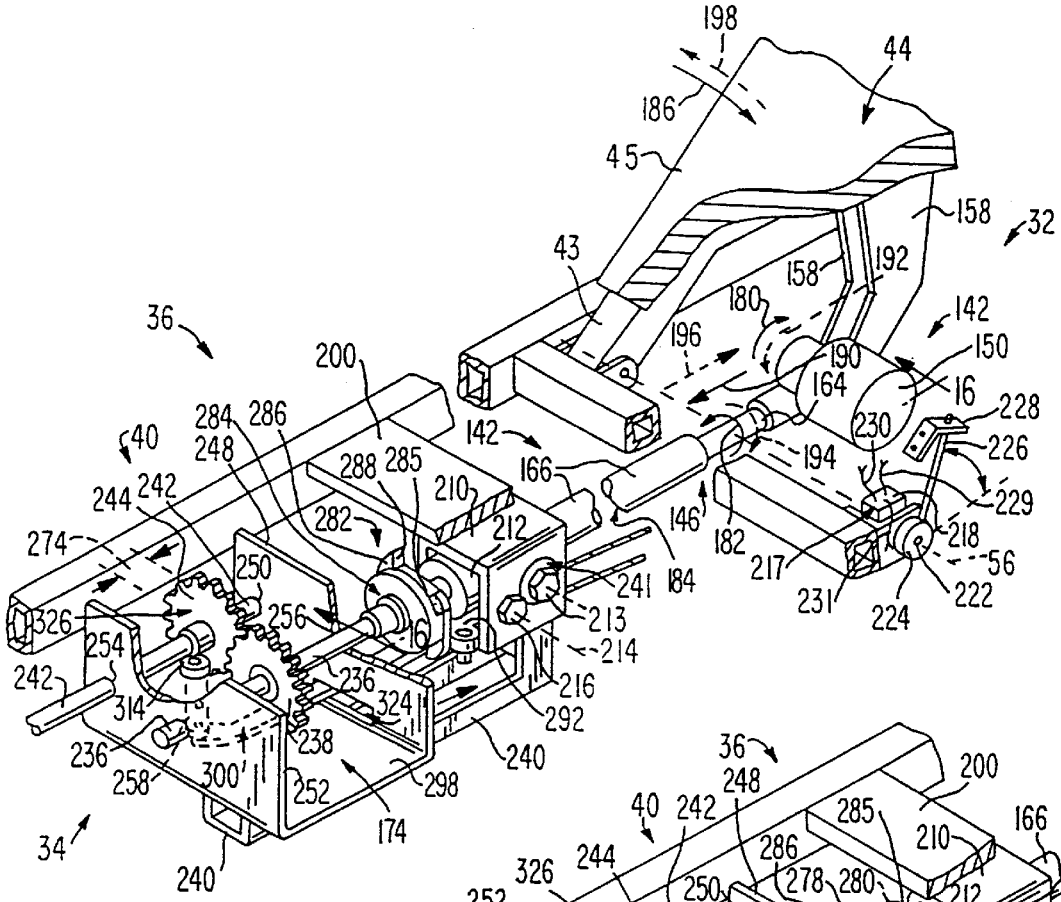
FIG.14 is a perspective view of the head section actuator of the stretcher of FIG. 8 with portions broken away showing an output shaft of a head section motor connected to the head section and rotating a drive tube to extend and retract the actuator to raise and lower the head section, a potentiometer for indicating the angular position of the head section relative to the frame, and a CPR release mechanism adjacent to the gear box and coupled to the head section actuator for allowing the head section to drop rapidly to the lowered position during an emergency when the caregiver activates the CPR release mechanism.
Figure 15:
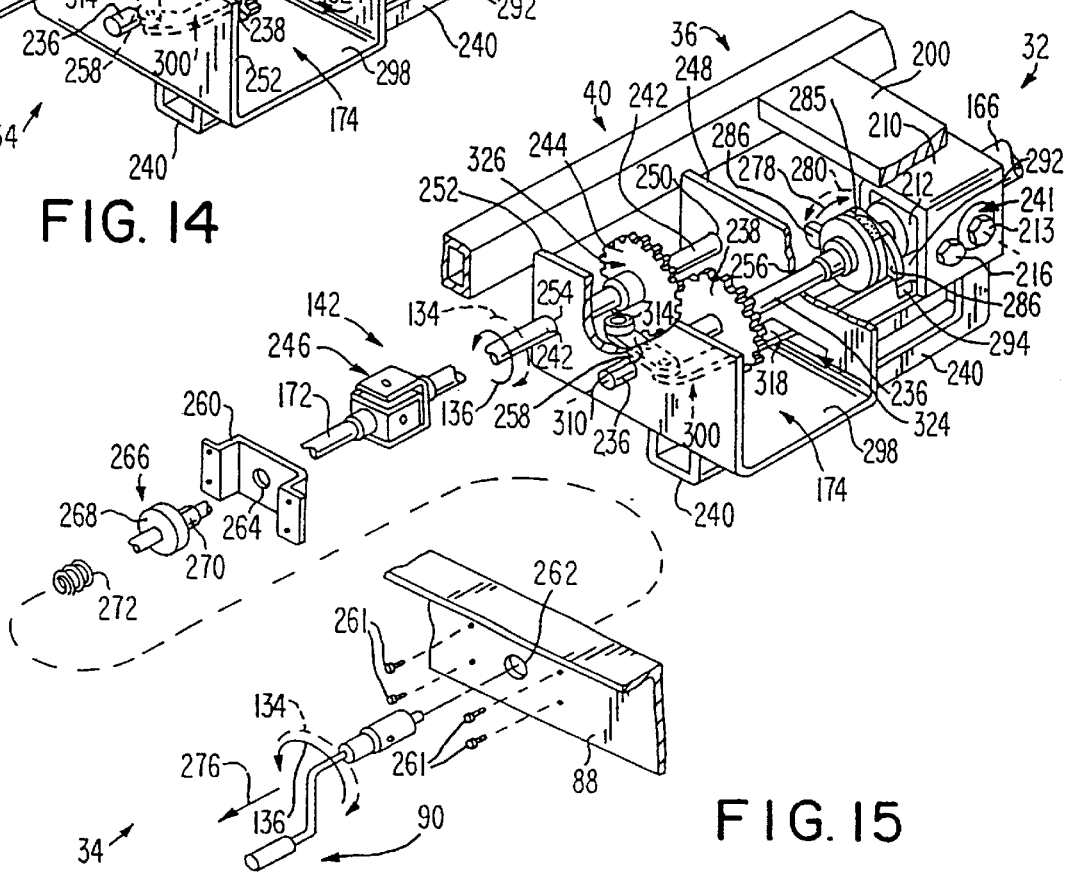
FIG. 15 is an exploded perspective view of the gear box of FIG. 14 and the head section hand crank with portions broken away showing the head section hand crank and the head section crank shaft moved axially rearwardly to a rearwardmost position so that the head section crank shaft can be manually rotated to move the head section.

A mounting bracket 210 is attached to frame member 200 and extends downwardly therefrom, as shown best in FIGS. 14 and 15. Drive mechanism 142 includes a sleeve 212 mounted to mounting bracket 210 by a pair of coaxial pivot bolts 216 so that sleeve 212 can pivot about a 20 transversely extending pivot axis 214 defined by bolts 216. Thus, drive mechanism 142 is coupled to head section 44 by pivot pin 162 and mounting flanges 158 and to frame 40 by bolts 216 and mounting bracket 210.

Drive tube 164 and tubular housing 166 are telescoping members and are maintained in a generally in-line orientation during axial movement of tube 164 relative to housing 166 as shown, for example, in FIGS. 7 and 8. Tubular housing 166 is fixed to sleeve 212 and extends from sleeve 212 toward head end 32 of stretcher 30 as shown in FIGS. 7, 8 and 16. As tube 164 moves axially relative to housing 166, tube 164 moves pivot pin 162 that connects drive mechanism 142 to head section 44 in an arc about pivot axis 56 so that as head section 44 moves between the raised and lowered positions, actuator 146 tilts slightly relative to frame 40 about pivot axis 214.

When power plug 154 receives power from a power outlet, head section 44 is between the raised and lowered positions, and the caregiver moves switch 124 to the head-up position while switch 126 is in the off position, an output shaft 178 of motor 150 rotates in a direction indicated by arrow 180 as shown in FIG. 14. Rotation of output shaft 178 in direction 180 operates through gear reducer 482 so that drive tube 164 telescopically extends out of interior region 184. Movement of drive tube 164 in direction 196 pivots head section 44 about pivot axis 56 in an upward direction indicated by arrow 198 (in phantom) as shown in FIG. 14.

When head section 44 is between the intermediate position and the lowered position and motor 150 receives power while button 96 is not deactivated by lockout switch 126, the patient can press button 96 or the caregiver can press button 96 or move switch 124 to the head-up position to rotate output shaft 178 of motor 150 thus translating drive tube 164 in direction 196 to telescopically extend drive tube 164 out of interior region 184 and to pivot head section 44 about pivot axis 56 in direction 198. Thus, switch 124 can be used to raise head section 44 up to the raised position and button 96 can be used to raise head section 44 up to the intermediate position.

When power plug 154 receives power from a power outlet, head section 44 is between the raised and lowered positions, and the caregiver moves switch 124 to the head-down position while switch 126 is in the off position, output shaft 178 of motor 150 rotates in a direction indicated by arrow 192 (in phantom) as shown in FIG. 14. Rotation of output shaft 178 in direction 192 operates through gear reducer 482 so that drive tube 164 telescopically retracts into interior region 184. Movement of drive tube 164 in direction 190 pivots head section 44 about pivot axis 56 in a downward direction indicated by arrow 186, as shown in FIG. 14.

When head section 44 is between the raised position and the lowered position and motor 150 receives power while button 98 is not deactivated by lockout switch 126, button 98 can be pressed to rotate output shaft 178 of motor 150 to telescopically retract drive tube 164 into interior region 184 and to pivot head section 44 about pivot axis 56 in direction 186. Thus, switch 124 can be used to lower head section 44 to the lowered position and button 98 can be used to lower head section 44 to the lowered position.

Gear box 174 is mounted to bracket 210 by a support bar 240 as shown in FIGS. 14 and 15. Support bar 240 is coupled to sleeve 212 of drive mechanism 142 and to bracket 210 by pivot bolts 216 so that gear box 174 pivots about pivot axis 214 when sleeve 212 pivots about axis 214 during movement of head section 44. Support bar 240 is also coupled to sleeve 212 by a pair of fastening bolts 213 as shown in FIGS. 14 and 15. Mounting bracket 210 is formed to include a pair of large apertures 241 that receive bolts 213. Apertures 241 are sized so that bolts 213 can move upwardly and downwardly relative to bracket 210 when sleeve 212 pivots about pivot axis 214 so that bolts 213 do not contact bracket 210.

Gear box 174 of head section drive mechanism 142 includes a shaft 236 and a gear 238 mounted on shaft 236 inside gear box 174 as shown in FIGS. 14 and 15. Head end 32 of shaft 236 is coupled to a drive shaft 188 of head section actuator 146. Gear box 174 also includes a shaft 242 and a gear 244 mounted on shaft 242.

Foot end 34 of shaft 242 is coupled to crank shaft 172 by a U-joint 246 as shown in FIG. 15. Gear box 174 includes a front wall 248 formed to include a front wall first aperture 250 and a rear wall 252 formed to include a rear wall first aperture 254 as shown in FIGS. 14 and 15. Shaft 242 is received by apertures 250, 254 for rotational and translational movement relative to gear box 174. In addition, front wall 248 is formed to include a front wall second aperture 256 and rear wall 252 is formed to include a rear wall second aperture 258. Shaft 236 is received by apertures 256, 258 for rotational movement relative to gear box 174.

Stretcher 30 includes a stop bracket 260 mounted to frame member 88 of frame 40 by fasteners 261 as shown in FIG. 15. Frame member 88 is formed to include an aperture 262 and stop bracket 260 is formed to include an aperture 264 aligned with aperture 262. Crank shaft 172 is received by apertures 262, 264 for rotational and translational movement with respect to bracket 260 and frame member 88. A tubular bushing 266 having a radially outwardly-extending thrust portion 268 is mounted to crank shaft 172. Bushing 266 is received by aperture 264 of stop bracket 260 with thrust portion 268 being positioned to lie between frame member 88 and stop bracket 260 as shown in FIG. 15. A biasing spring 272 is mounted on crank shaft 172 and is maintained in a state of compression against frame member 88 and thrust portion 268 of bushing 266. Spring 272 biases bushing 266 into contact with stop bracket 260.

When the caregiver pulls hand crank 90 axially rearwardly, as indicated by arrow 276 in FIG. 15, crank shaft 172, U-joint 246, and shaft 242 of gear box 174 move axially in direction 276. When the caregiver pulls hand crank 90 in direction 276, gear 244 also moves in direction 276 by a distance 274 until gear 244 engages gear 238, as shown in FIG. 15, at which point hand crank 90 and crank shaft 172 are in a rearwardmost position.

After the caregiver moves hand crank 90 to the rearwardmost position so that gear 244 engages gear 238, the caregiver can rotate hand crank 90 in direction 136 to rotate shaft 242 and gear 244 in direction 136 rotating gear 238 and shaft 236 in a direction indicated by arrow 278 as shown in FIG. 15. Actuator 146 is coupled to shaft 236 so that rotation of shaft 236 in direction 278 causes drive tube 164 to telescopically retract into interior region 184 of tubular housing 166. Movement of drive tube 164 in direction 190 pivots head section 44 downwardly about pivot axis 56 in direction 186. Thus, the caregiver can manually lower head section 44 by pulling hand crank 90 in direction 276 to the rearwardmost position and then rotating hand crank 90 in direction 136.

After the caregiver moves hand crank 90 to the rearwardmost position, the caregiver can manually rotate hand crank 90 in direction 134 to rotate shaft 242 and gear 244 in direction 134 thus rotating gear 238 and shaft 236 in a direction indicated by arrow 280 as shown in FIG. 15 (in phantom). Actuator 146 is coupled to shaft 236 so that rotation of shaft 236 in direction 280 causes drive tube 164 to telescopically extend out of interior region 184 of tubular housing 166. Movement of drive tube 164 in direction 196 pushes flanges 158 forward head end 32 of stretcher 30 and thereby pivots head section 44 upwardly about pivot axis 56 in direction 198. Thus, the caregiver can manually raise head section 44 by pulling hand crank 90 in direction 276 to the rearwardmost position and then rotating hand crank 90 in direction 134.

Stretcher 30 includes a CPR release mechanism 282 that can be actuated by CPR release handles 94 to quickly lower head section 44 to the lowered position. Mechanism 282 includes a collar assembly 284 coupled to shaft 236 of gear box 174 as shown in FIGS. 14–16. When the caregiver moves hand crank 90 to the rearwardmost position and manually rotates hand crank 90 causing gears 244, 238 to rotate, collar assembly 284 rotates along with shaft 236 causing drive tube 164 to telescopically extend and retract relative to housing 166 because collar assembly 284 couples shaft 236 to actuator 146.

Collar assembly 284 includes a ring 285 having a pair of diametrically opposed lugs 286 that project radially outwardly as shown in FIGS. 14–16. Each lug 286 has a flat locking edge 288 and a curved cam edge 290. CPR release mechanism 282 also includes a latch 292 mounted to sleeve 212 underneath sleeve 212 as shown in FIGS. 14–20. Latch 292 includes a flat locking edge 294 and a curved ratchet edge 296. Latch 292 has a rearward locking position shown in FIGS. 14, 17, and 18 wherein edge 294 engages one of edges 288 of lugs 286 to prevent the rotation of ring 285 and shaft 236 relative to frame 40. Latch 292 also has a forward releasing position shown in FIGS. 15, 19, and 20 wherein edge 294 is pulled away from lugs 286 to allow rotation of ring 285 and shaft 236 relative to frame 40.

Head section actuator 146 includes a gear reducer 334 mounted to motor 150. Gear reducer 334 includes a worm 336 that is fixed to output shaft 178 of motor 150 as shown in FIG. 16 (in phantom). Gear reducer 334 also includes a drive shaft 340 and a worm gear 338 fixed to drive shaft 340 as also shown in FIG. 16 (in phantom). Bearings (not shown) support drive shaft 340 within gear reducer 334. The bearings allow drive shaft 340 to rotate but hold drive shaft 340 against axial movement relative to motor 150. Worm gear 338 meshes with worm 336 so that rotation of output shaft 178 rotates worm gear 338 and drive shaft 340.

Latch 292 is formed to include a pair of slots 352 and a bolt 354 extends through each slot 352, each bolt 354 being attached to sleeve 212 so that latch 292 is coupled to sleeve 212 as shown in FIGS. 16–20 for sliding movement relative to sleeve 212. CPR release mechanism 282 includes a spring 356 having a head end 32 attached to latch 292 by a post 358 and a foot end 34 attached to a cable plate 359 mounted to bolts 354 below latch 292 so that spring 356 yieldably biases latch 292 toward the locking position.

If an object inadvertently gets caught between U-shaped frame member 43 of head section 44 and frame 40 while motor 150 is activated to pivot head section 44 about axis 56 toward the lowered position, gravity will no longer be transmitted through actuator 146 to frame 40 but will rather be transmitted from head section 44 to frame 40 through the object. As a result, actuator 146 causes ring 285 to rotate relative to latch 292. Thus, continued activation of motor 150 to lower head section 44 causes motor 150 to rotate but does not cause head section actuator 146 to pull head section 44 toward the lowered position. Instead, the rotation of motor 150 while head section 44 is constrained from pivoting downwardly causes rotation of ring 285 of collar assembly 284 in direction 182 and separates edge 288 of lug 286 away from edge 294 of latch 292. During rotation of ring 285 in direction 182, cam edge 290 of each lug 286 wipes against edge 296 of latch 292 to slide latch 292 from the locking position to the releasing position. When lugs 286 rotate out of the way of latch 292, spring 356 urges latch 292 back into the locking position. Thus, lugs 286 of ring 285 cause latch 292 to ratchet between the locking position and the releasing position when motor 150 is activated to lower head section 44 while head section 44 is constrained from doing so.

Drive mechanism 142 includes a linkage 300 that couples gear 244 to latch 292 as shown in FIGS. 14 and 15. When the caregiver moves hand crank 90 to the rearwardmost position, linkage 300 is actuated and moves latch 292 from the locking position, shown in FIG. 14, to the releasing position, shown in FIG. 14, so that lugs 286 are away from latch 292 when the caregiver rotates hand crank 90. Linkage 300 is discussed below in detail with reference to FIGS. 17–20.

Gear box 174 includes a bottom wall 298 that connects front wall 248 and rear wall 252 of gear box 174 as shown in FIGS. 14 and 15. Linkage 300 includes a first link 310 having a middle portion pivotably coupled to bottom wall 298 by a pivot pin 312. A roller 314 is mounted to a first end 316 of link 310 by an axle pin 518 as shown in FIGS. 18–20. Linkage 300 also includes a second link 318 having a first end 320 pivotably coupled to a second end 322 of link 310 by a pivot pin 520. Front wall 248 of gear box 174 is formed to include a slot 324 and link 318 extends from link 310 through slot 324 toward head end 32 of stretcher 30. A post 516 extends downwardly from first side 36 of latch 292 and a second end 325 of link 318 is coupled to post 516 as shown in FIGS. 17–20.

When latch 292 is in the locking position and gear 244 is disengaged from gear 238, linkage 300 is in an unactuated position as shown in FIG. 18. Roller 314 is yieldably biased against a face 326 of gear 244 by spring 356 which biases latch 292 into the locking position when linkage 300 is in the unactuated position.

CPR release mechanism 282 includes a first CPR release handle 94 positioned to lie adjacent to first side 36 of stretcher 30 and a second CPR release handle 94 positioned to lie adjacent to second side 38 of stretcher 30 as shown in FIGS. 1 and 21–26. As described above, when either handle 94 is moved from the locking position to the releasing position, head section 44 lowers to the lowered position more quickly than if patient control buttons 78, caregiver control switches 86, or head section hand crank 90 are used to lower head section 44.

Figure 21:
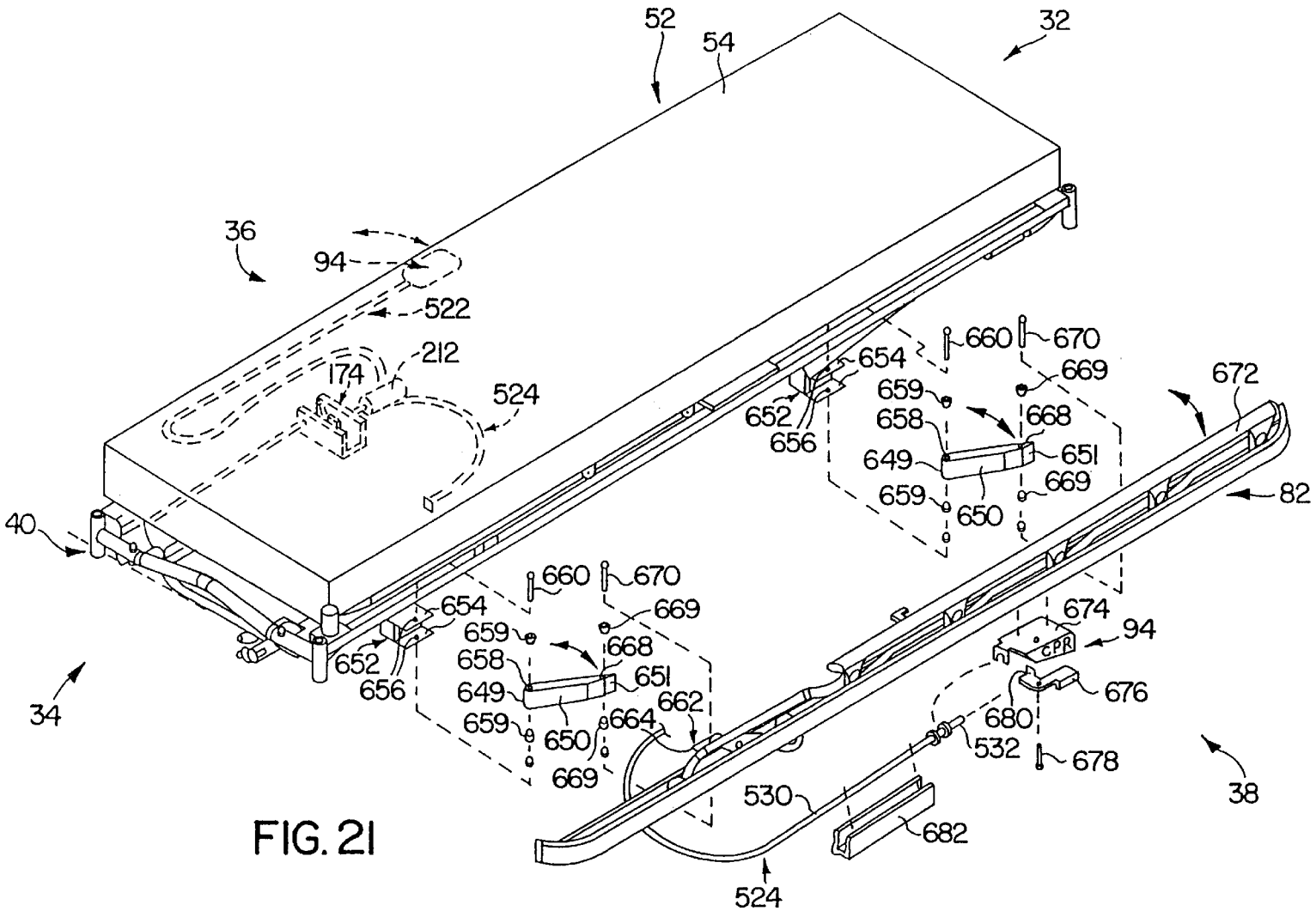
FIG. 21 is an exploded view of the frame and patient-support deck of the stretcher of FIG. 1 showing each CPR release handle mounted to one of the movable side guard rails, each CPR release handle coupled to the CPR release mechanism by a bowden wire (in phantom), and one of the side rails mounted to the frame by a pair of longitudinally spaced-apart mounting arms that allow the side rail and CPR release handle to swing laterally relative to the frame.

Each CPR release handle 94 is mounted to one of side guard rails 80, 82. Stretcher 30 includes a first pair of longitudinally spaced-apart mounting arms 650 pivotably coupled to side guard rail 80 and pivotably coupled to first side 36 of frame 40 and a second pair of longitudinally spaced-apart mounting arms 650 pivotably coupled to side guard rail 82 and pivotably coupled to second side 38 of frame 40, as shown in FIGS. 21, 22, 25, and 26. Frame 40 includes a pair of C-shaped brackets 652 having vertically spaced apart plates 654 and each plate 654 is formed to include an aperture 656. A first end 649 of each mounting arm 650 is formed to include an aperture 658 and a pair of bushings 659 are received by aperture 658 as shown in FIG. 21. End 649 of each mounting arm 650 is positioned between plates 654 so that apertures 656 are vertically aligned with aperture 658. A coupling pin 660 is received by apertures 656, 658 to pivotably couple each mounting arm 650 to frame 40.

Figure 26:
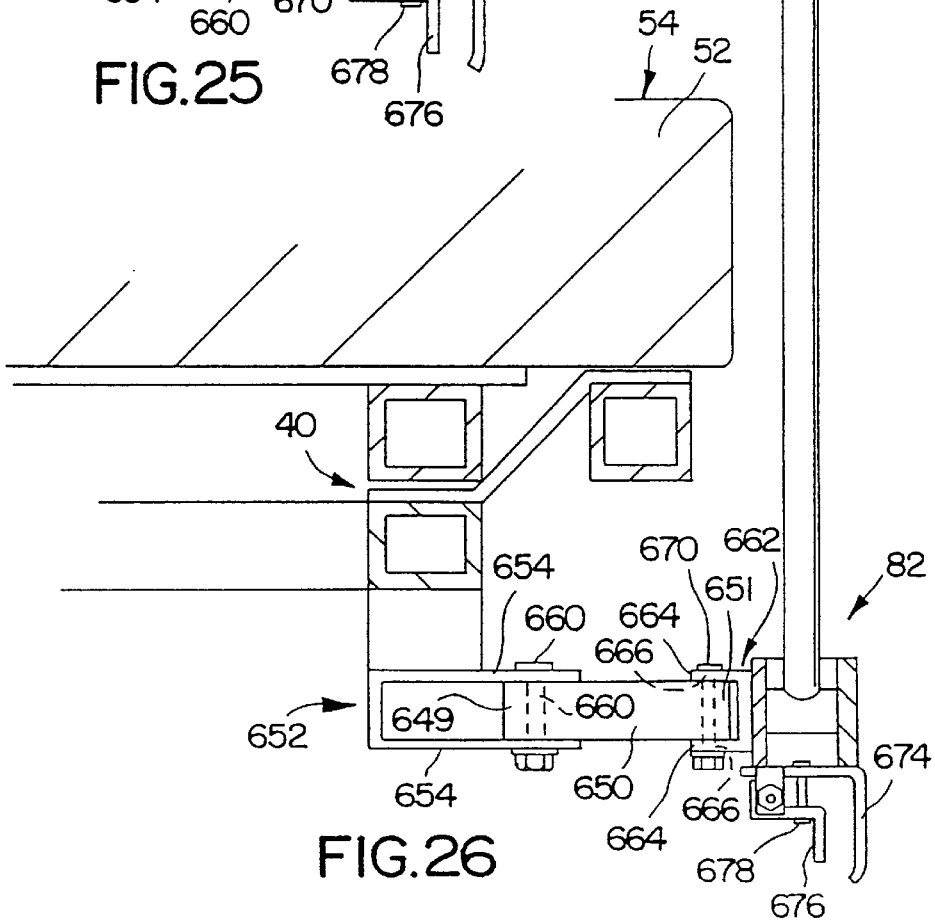
FIG. 26 is a view similar to FIG. 25 showing the side rail and CPR release handle moved to the extended position, the top rail moved to a raised position above the patient-support deck, and the mounting arms supporting the side rail in the extended position.

In addition, each of side guard rails 80, 82 includes a pair of C-shaped brackets 662 having vertically spaced apart plates 664 and each plate 664 is formed to include an aperture 666 as shown best in FIG. 26. A second end 651 of each mounting arm 650 is formed to include an aperture 668 and a pair of bushings 669 are received by aperture 668 as shown in FIG. 21. End 651 of each mounting arm 650 is positioned between plates 664 so that apertures 666 are vertically aligned with aperture 668. A coupling pin 670 is received by apertures 666, 668 to pivotably couple each mounting arm 650 to respective side guard rails 80, 82.

Figure 22:
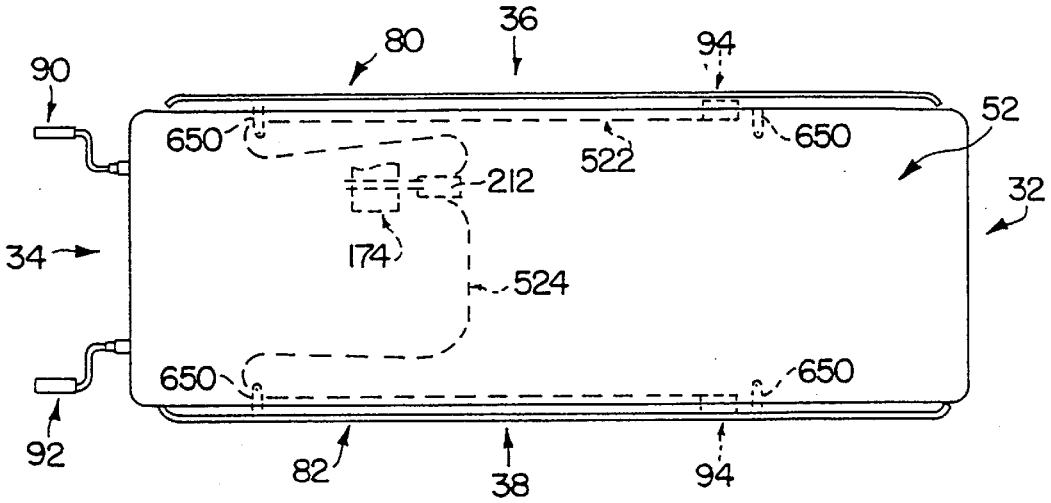
FIG. 22 is a top plan view of the stretcher of FIG. 21 showing each of the side guard rails in an extended position having the mounting arms extending generally transversely outwardly from underneath the patient-support deck.
Figure 25:
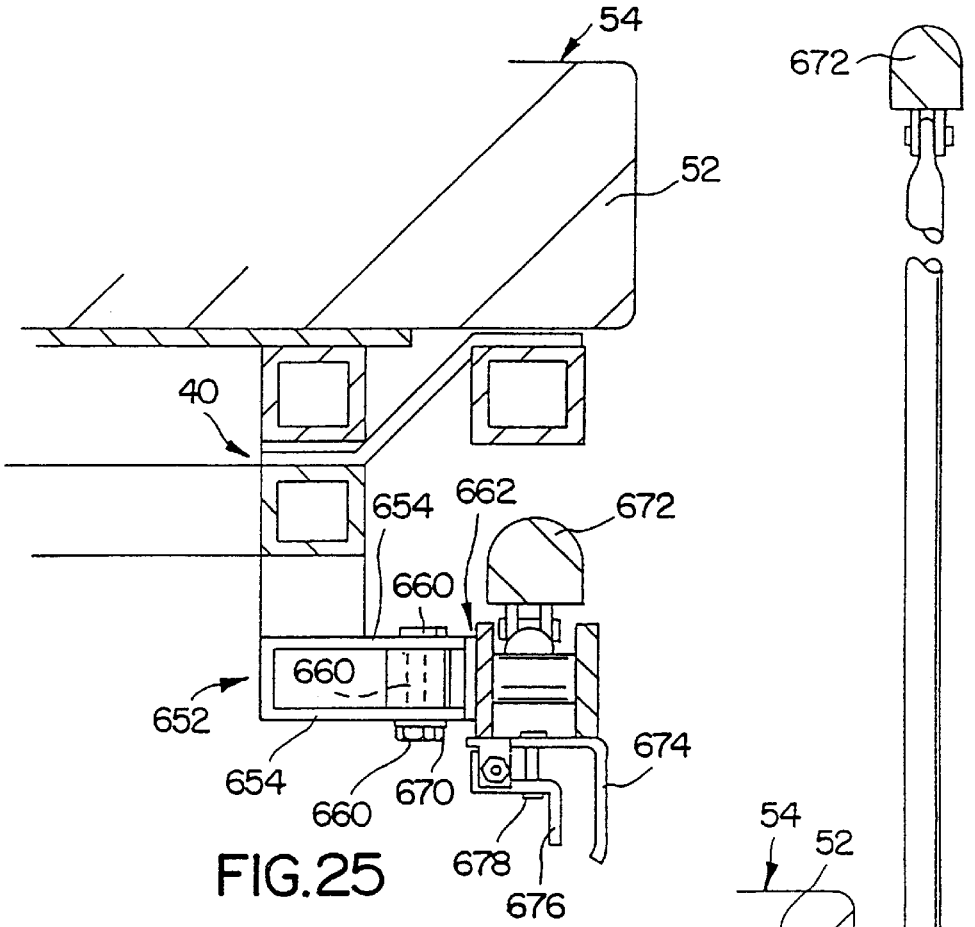
FIG. 25 is an end elevation view of the CPR release handle and side rail of FIG. 24 with portions broken away showing a top rail of the side rail in a lowered position and the side rail and CPR release handle moved to a stored position tucked underneath the patient-support deck.

Frame 40 cooperates with mounting arms 650 and each side guard rail 80, 82 to form parallelogram linkages allowing side guard rails 80, 82 to swing laterally relative to frame 40 between an extended position, as shown in FIGS. 22 and 26, and a stored position, as shown in FIG. 25. When side guard rails 80, 82 are in the extended positions, mounting arms 650 extend transversely away from frame 40, as shown best in FIG. 22, to support side guard rails 80, 82 in spaced-apart relation from frame 40. Each of side guard rails 80, 82 include a top rail 672 that can be moved from a lowered position below patient-support surface 54 of mattress 52, as shown in FIG. 25, to a raised position above surface 54, as shown in FIG. 26, to prevent the inadvertent movement of the patient carried on surface 54 past the sides of mattress 52 and off of stretcher 30 when rails 80, 82 are in the extended position and top rails 672 are raised.

When top rails 672 are in the lowered position, rails 80, 82 can be moved to the stored position and tucked underneath patient-support deck 42 as shown in FIG. 25. CPR release handles 94 are also tucked underneath deck 42 when rails 80, 82 are in the stored position because handles 94 are mounted to rails 80, 82. However, handles 94 are still readily accessible for actuation by the caregiver when rails 80, 82 are in the stored position.

Figure 23:
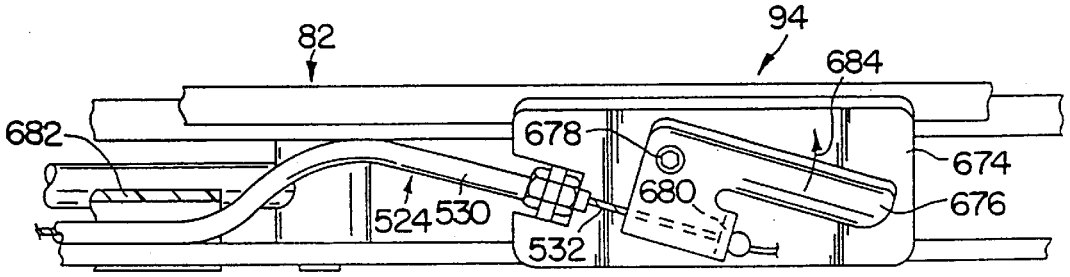
FIG. 23 is bottom plan view of one of the CPR release handles showing a hand rest of the CPR release handle mounted to the side rail, an activation handle pivotably mounted to the hand rest and in a locking position, and a flexible cable of the bowden wire coupled to a tab of the activation handle.
Figure 24:
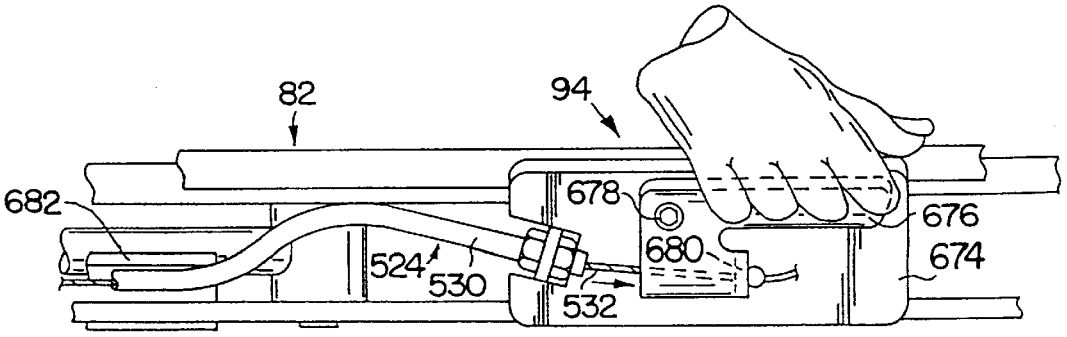
FIG. 24 is view similar to FIG. 23 showing the caregiver pivoting the activation handle to a releasing position causing the tab of the handle plate to pull the cable of the bowden wire relative to a sheath of the bowden wire to move the latch of the CPR release mechanism to the releasing position so that the head section quickly lowers.

Each CPR release handle 94 includes a hand rest 674 that mounts to one of rails 80, 82 underneath rails 80, 82, as shown in FIGS. 21, and 23–26. Each CPR release handle 94 also includes an activation handle 676 that is coupled to hand rest 674 by a pivot bolt 678 for pivoting movement between the locking position, as shown in FIG. 23, and the releasing position, as shown in FIG. 24.

A first bowden wire 522 couples latch 292 to activation handle 676 of first CPR release handle 94 and a second bowden wire 524 couples latch 292 to activation handle 676 of second CPR release handle 94. First bowden wire 522 includes a flexible cable 528 enclosed in a sheath 526 and second bowden wire 524 includes a flexible cable 532 enclosed in a sheath 530 as shown in FIGS. 17–20. Each activation handle 676 includes a tab 680 and cable 528, 532 is attached to tab 680 of its respective activation handle 676 so that cables 528, 532 slide within sheaths 526, 530 when activation handle 676 of the corresponding CPR release handle 94 moves between its locking and releasing positions.

Cable plate 359 includes opposing transversely-extending tabs 534 that are crimped around sheaths 526, 530 of first and second bowden wires 522, 524, respectively. Cable 528 extends from sheath 530 and couples to post 516 below link 318 of linkage 300 as shown in FIGS. 17–20. Similarly, cable 532 extends from sheath 530 and couples to a post 536 that extends downwardly from latch 292.

When the caregiver moves first CPR release handle 676 from the locking position to the releasing position, cable 528 is pulled relative to sheath 526 and cable plate 359 in a direction indicated by arrow 538 as shown in FIG. 19 (in phantom). Likewise, when the caregiver moves second CPR release handle from the locking position to the releasing position, cable 532 is pulled relative to sheath 530 and cable plate 359 in a direction indicated by arrow 540 as also shown in FIG. 19.

A U-shaped rail 682 defining a channel is mounted to side guard rails 80, 82. Bowden wires 522, 524 are routed from activation handles 676 toward foot end 34 of stretcher 30 through the channel formed in U-shaped rails 682. Bowden wires 522, 524 loop around respective brackets 650 which are nearest foot end 34 of stretcher 30 and are then routed to latch 292, as shown in FIGS. 21 and 22 (in phantom) so that each of bowden wires 522, 524 forms somewhat of an S-shaped configuration. The S-shaped configuration of each of bowden wires 522, 524 provides wires 522, 524 with sufficient excess length of cable 528, 532, respectively, and sheath 526, 530, respectively, to allow rails 80, 82 to be moved between the stored and extended positions without wires 522, 524 being pulled taut, thereby avoiding mechanical problems such as premature failure of bowden wires 522, 524 and the inadvertent movement of latch 292.

The caregiver can place the heel and thumb of his or her hand on hand rest 674 and use his or her fingers to squeeze activation handle 676, as shown in FIG. 24, to pivot activation handle 676 about pivot bolt 678 in the direction indicated by arrow 684, shown in FIG. 23, from the locking position to the releasing position. Movement of activation handle 676 in direction 684, as shown, for example, for bowden wire 524 in FIGS. 23 and 24, pulls cable 532 of bowden wire 524 relative to sheath 530 which moves latch 292 from the locking position to the releasing position allowing head section 44 to quickly move to the lowered position.

Figure 17:
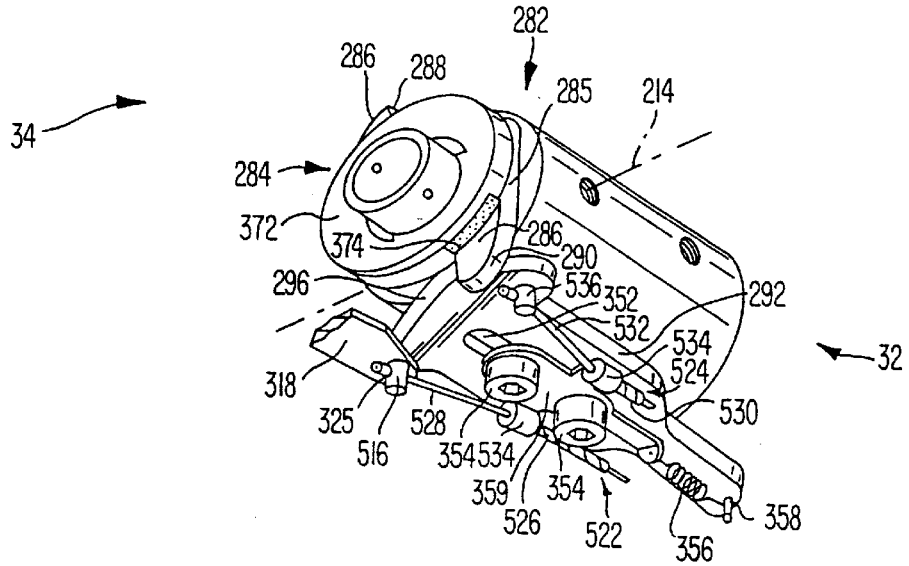
FIG. 17 is a perspective view of the bottom of the CPR release mechanism of FIG. 16 showing a latch in a locking position engaging a lug to prevent rotation of the drive screw.
Figure 18:
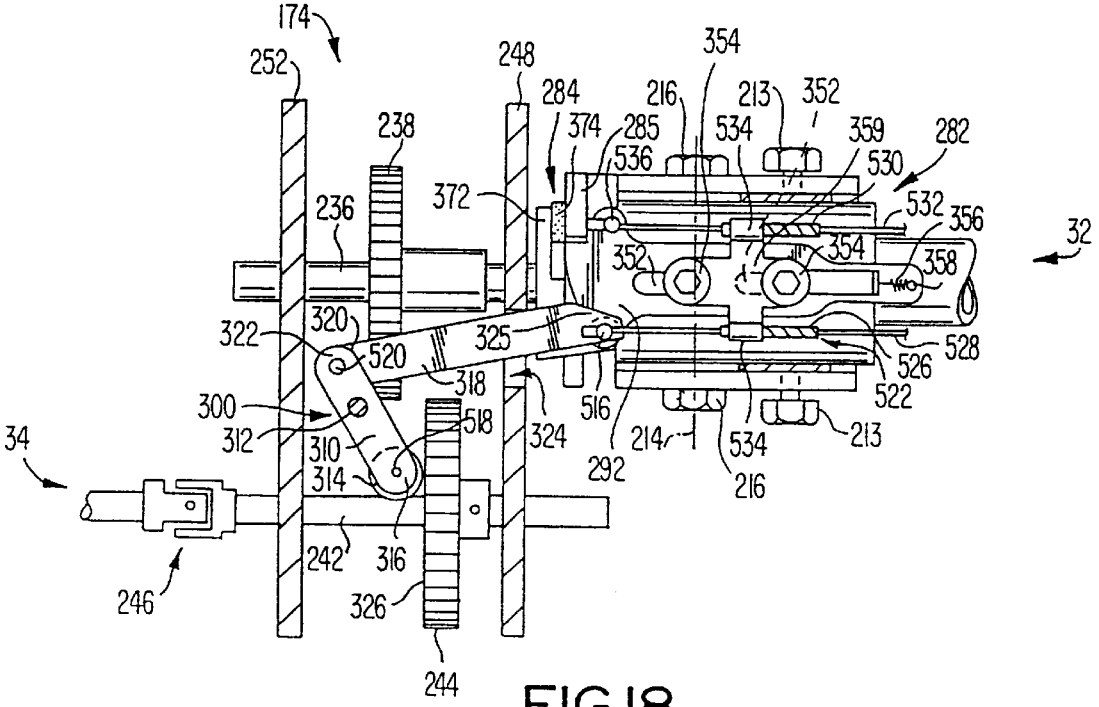
FIG. 18 is a bottom plan view of the CPR release mechanism of FIG. 17 showing the latch in the locking position engaging the lug, a linkage coupled to the latch, and the linkage having a roller that engages a face of a gear that is coupled to the head section crank shaft.
Figure 19:
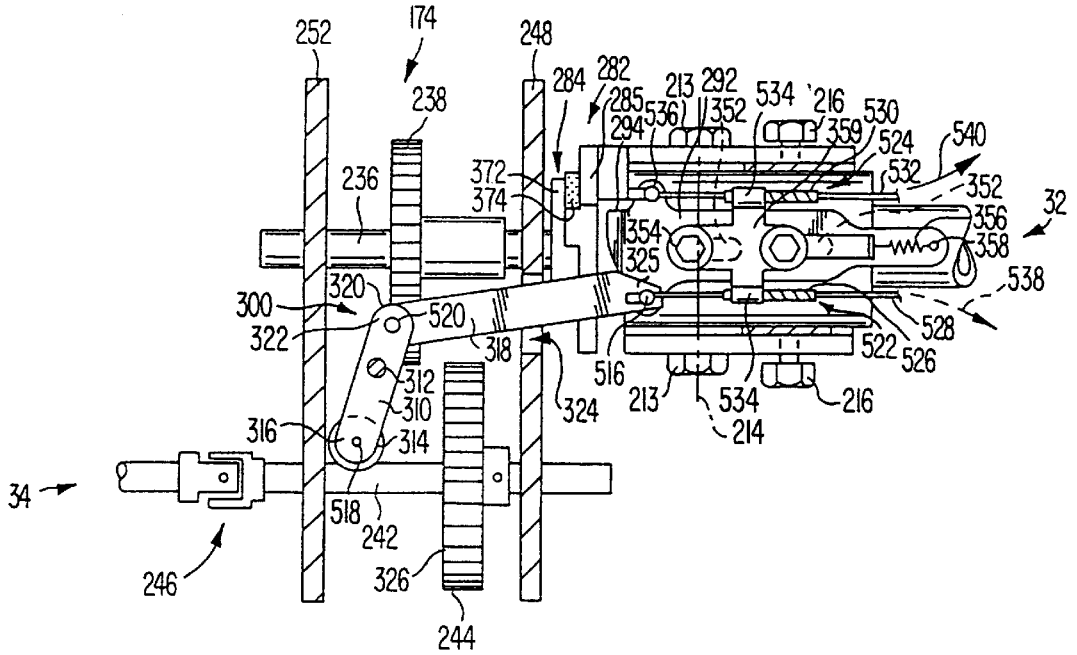
FIG. 19 is a view similar to FIG. 18 showing the latch moved to a releasing position disengaged from the lug by one of a pair of spaced-apart bowden wires that are coupled to respective CPR release handles.
Figure 20:
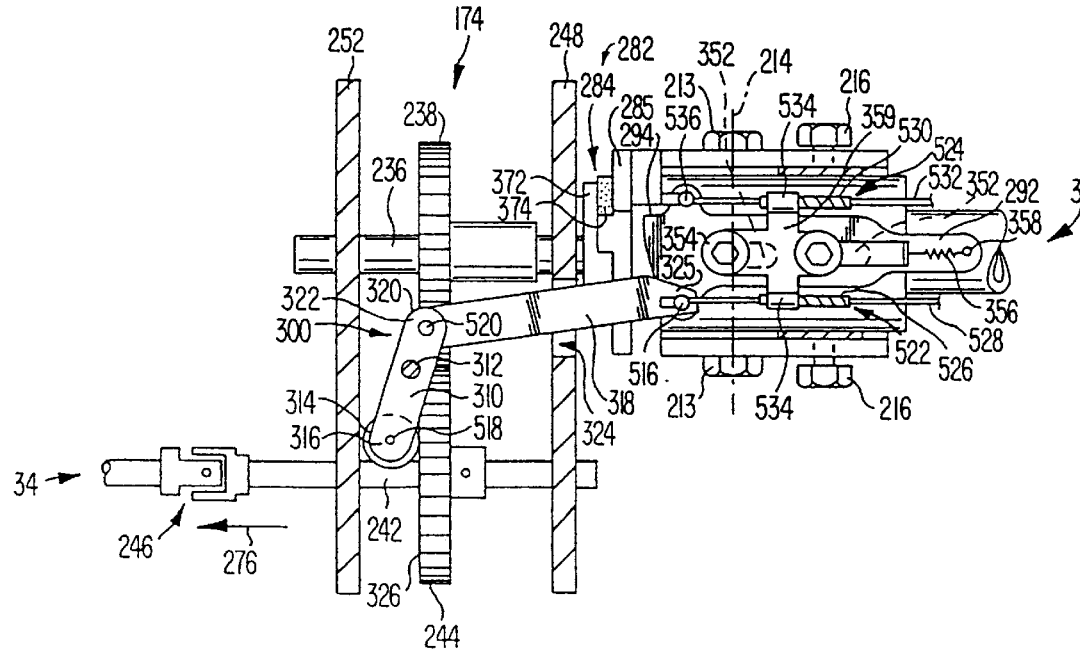
FIG. 20 is a view similar to FIG. 19 showing the head section crank shaft moved axially rearwardly to the rearwardmost position so that the gear coupled to the head section crank shaft engages the gear coupled to the drive screw and the latch moved by the linkage from the locking position to the releasing position so that rotation of the head section crank shaft will rotate the gears and the drive screw.

Movement of either of cables 528, 532 in respective directions 538, 540 moves latch 292 from the locking position shown in FIGS. 17 and 18 to the releasing position shown in FIGS. 19 and 20. Movement of latch 292 to the releasing position by actuation of either CPR release handle 94 also moves linkage 300 from the unactuated position to an actuated position as shown in FIG. 19. Actuation of either release handle 676, moving handle 676 to the releasing position, pulls link 318 toward head end 32 of stretcher 30 and pivots link 310 about pin 312 thus moving roller 314 out of contact with face 326 of gear 244.

When the caregiver moves either release handle 94 to the releasing position so that latch 292 moves to the releasing position as shown in FIG. 19, latch 292 no longer engages lugs 286 to prevent ring 185 from rotating in direction 278. When ring 285 rotates, shaft 236 and gear 238 of gear box 174 also rotate but gear 244 and shaft 242 do not rotate because gear 244 is disengaged from gear 238.

As shaft 236 rotates in direction 278, drive tube 164 translates toward foot end 34 of stretcher 30 and head section 44 pivots toward the lowered position until head section 44 reaches the lowered position when head section 44 engages strut 95 of frame 40. Stretcher 30 includes a dashpot (not shown) to limit the rate at which head section 44 lowers when CPR release handles are actuated. However, the dashpot selected allows head section 44 to lower at a faster rate when CPR release handles 94 are actuated than when motor 150 is activated or when hand crank 90 is manually rotated to lower head section 44.

When the caregiver moves hand crank 90 to the rearwardmost position, gear 244 is pulled toward foot end 34 of stretcher 30 and into engagement with gear 238 as shown in FIG. 20. In addition, face 326 of gear 244 engages roller 314 and pushes roller 314 toward foot end 34 of stretcher 30. Movement of roller 314 toward foot end 34 of stretcher 30 pivots first link 310 about pivot pin 312 relative to bottom wall 298 of gear box 174 and pushes second link 318 toward head end 32 of stretcher 30 thereby moving linkage 300 to the actuated position. As described above, movement of linkage 300 to the actuated position moves latch 292 to the releasing position. Once latch 292 is in the releasing position, the caregiver can rotate hand crank 90 to move head section 44 between the raised and lowered positions.

When the caregiver lets go of hand crank 90, spring 356 urges latch 292 into the locking position which, in turn, moves linkage 300 into the unactuated position. Movement of linkage 300 into the unactuated position causes roller 314, which is biased against face 326 of gear 244 by spring 356, to move gear 244, shaft 242, U-joint 246, crank shaft 172, and hand crank 90 toward head end 32 of stretcher 30 until latch 292 reaches the locking position.

Stretcher 30 includes a head section position sensor 218 mounted to transverse member 49 and coupled to head section 44, as shown in FIG. 14, for sensing the position of head section 44. Position sensor 218 of stretcher 30 is a potentiometer 218 including a post 222 that can be rotated to adjust the magnitude of an output voltage of potentiometer 218. A knob 224 is fixed to post 222 and a lever 226 extends from knob 224 and is coupled to head section 44. Potentiometer 218 is mounted to frame 40 so that knob 224 and post 222 rotate about first pivot axis 56 when head section 44 pivots about axis 56.

Potentiometer 218 includes an output lead 231, a first power lead 229, and a second power lead 230 as shown in FIG. 14. Leads 229, 230, 231 are coupled to a control logic board, which is denoted by block 234 in FIG. 27, contained within an electronic control box 220 shown in FIGS. 1, 5, and 6, and power lead 230 is coupled to ground. Movement of head section 44 adjusts the magnitude of the voltage between output lead 231 and second power lead 230 which is at ground potential. The magnitude of the voltage between output lead 231 and ground potential varies in response to the angle at which head section 44 is elevated above frame 40 to provide a feedback signal 232 to logic board 234 of control box 220, as shown in FIG. 27.

Buttons 96, 98, 100, 110 of patient control buttons 78 mounted to first side guard rail 80 provide first input signals 542 to control logic board 234 as shown in FIG. 27. Similarly, buttons 96, 98, 100, 110 of patient control buttons 78 mounted to second side guard rail 82 provide second input signals 544 to control logic board 234. In addition, caregiver control switches 86 provide caregiver input signals 546 to logic control board 234.

Logic control board 234 contains a logic circuit (not shown) that provides output signals 554, 558 to motors 150, 152 in response to feedback signal 232 and input signals 542, 544, 546. Under appropriate circumstances, as described below with reference to FIGS. 28–33, motor 150 will activate in response to output signal 554 and motor 152 will activate in response to output signal 558. In addition, board 234 provides output signals 555, 559 to head section lockout light 130 and thigh section lockout light 132, respectively, so that light 130 will turn on when buttons 96, 98 are enabled in response to output signal 555 and light 132 will turn on when buttons 100, 110 are enabled in response to output signal 559. Thus, stretcher 30 has an electrical control system 208 including patient control buttons 78, caregiver control switches 86, potentiometer 218, control logic board 234, lockout lights 130, 132, and motors 150, 152 of actuators 146, 148, respectively.

When head section 44 is elevated relative to frame 40 greater than certain predetermined limits, as described in detail below with reference to FIGS. 28–33, potentiometer 218 provides input signal 232 to control logic board 234 and, in response to input signal 232, control logic board 234 will effectively "disable" or "lockout" one or more of buttons 96, 98, 100, 110 and switch 124 so that output signals 554, 558 do not cause motors 150, 152, respectively, to activate in response to input signals 542, 544, 546 regardless of whether switch 126 or switch 128 have been moved to the respective on positions. In addition, when input signal 232 from potentiometer 218 indicates that head section 44 elevation is less than the predetermined limits, control logic board 234 may, in response to input signal 232, "enable" one or more of buttons 96, 98, 100, 110 and switch 124 so that output signals 554, 558 can cause motors 150, 152, respectively, to activate in response to input signals 542, 544, 546 if switches 126, 128 of caregiver switches 86 are not disabling one or more of buttons 96, 98, 100, 110 and switch 124, which would otherwise be enabled.

The predetermined limits of head section 44 of stretcher 30 include a "limit 1" angle, a "limit 2" angle, a "limit 3" angle, and a "limit 4" angle. The limit 1 angle denotes when head section 44 is in the lowered position and is approximately one degree (1°). The limit 2 angle denotes when head section 44 is in the intermediate position and is approximately sixty degrees (60°). The limit 3 angle denotes when head section 44 is elevated at an angle of approximately sixty-three degrees (63°). Finally, the limit 4 angle denotes when head section 44 is in the raised position and is approximately eighty-eight degrees (88°).

Figure 28:
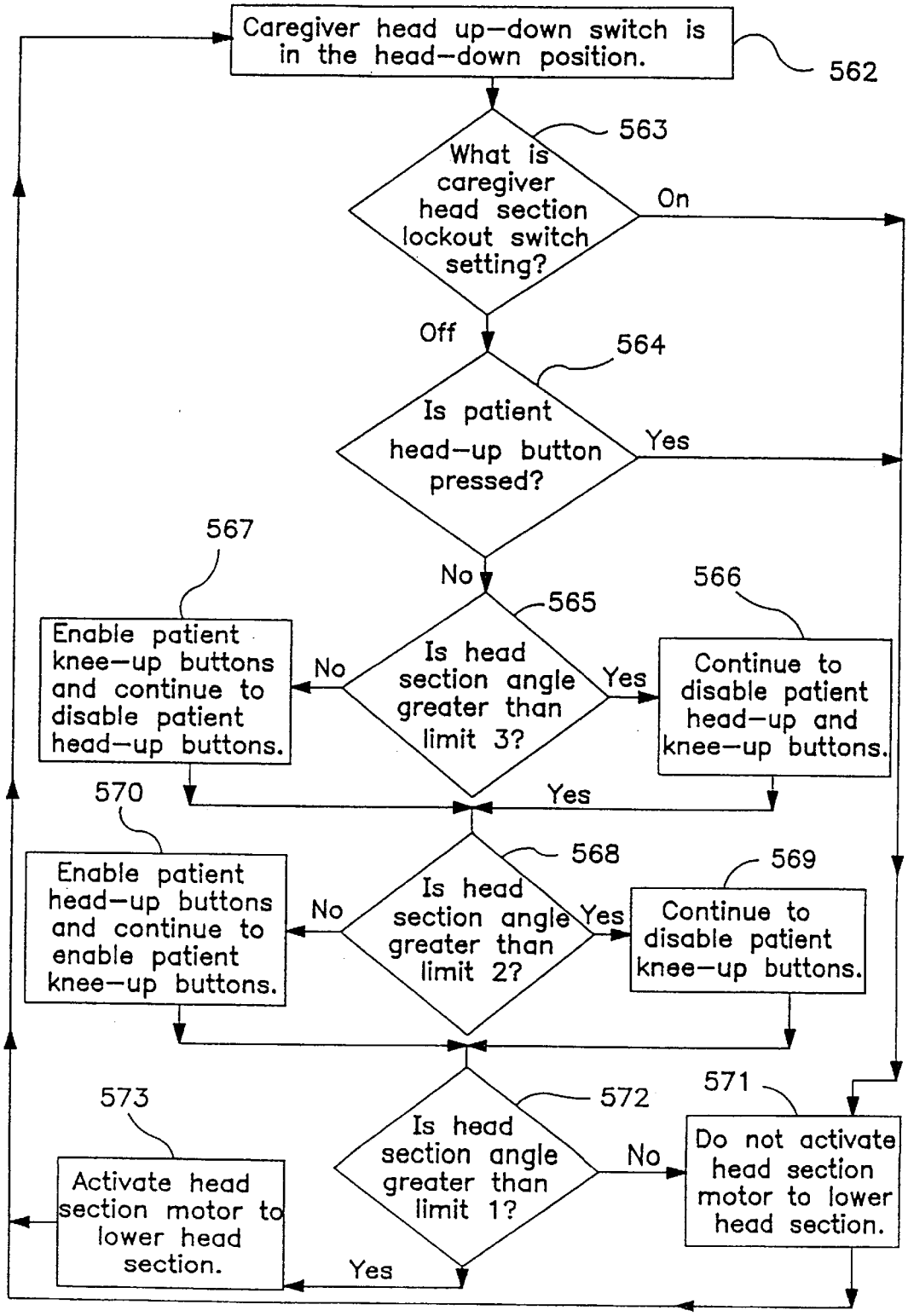
FIG. 28 is a flow chart illustrating the steps performed by the electrical system when the caregiver head up-down switch is in a head-down position.

FIG. 28 illustrates a flow chart of the steps performed by electrical system 208 of stretcher 30 when caregiver head up-down switch 124 of caregiver control switches 86 is moved to the head-down position, as indicated at block 562. After the caregiver moves switch 124 to the head-down position, control logic board 234 receives signals 232, 542, 544, 546 and determines at block 563 whether head section lockout switch 126 is in the on position, in which case buttons 96, 98 and switch 124 are locked out from activating motor 150 to move head section 44, or the off position, in which case buttons 96, 98 and switch 124 are not locked out. If lockout switch 126 is on, output signal 554 will not activate motor 150 to lower head section 44, as indicated at block 571.

If lockout switch 126 is off, board 234 determines at block 564 whether head-up button 96 is pressed. If button 96 is pressed while switch 124 is in the head-down position and switch 126 is off, then board 234 is receiving conflicting input signals 542, 544, 546 and output signal 554 will not activate motor 150 to lower head section 44, as indicated at block 571.

If lockout switch 126 is off and button 96 is not pressed, board 234 will determine at block 565 whether the angle of head section 44, as indicated by potentiometer 218 through feedback signal 232, is greater than the limit 3 angle. If the head section angle is not greater than limit 3, then board 234 will enable patient knee-up button 100, as indicated at block 567, and either the caregiver or the patient will be able to press buttons 100 to raise thigh section 48 assuming switch 128 is not in the on position disabling buttons 100. Board 234 will also continue to disable head-up button 96 if the head section angle is not greater than limit 3, as also indicated at block 567. If the head section angle is greater than limit 3 then board 234 will continue to disable head-up buttons 96 and knee-up buttons 100, as indicated at block 566.

If lockout switch 126 is off and button 96 is not pressed, board 234 will determine at block 568 whether the angle of head section 44, as indicated by potentiometer 218 through feedback signal 232, is greater than the limit 2 angle. If the head section angle is not greater than limit 2, then board 234 will enable patient head-up buttons 96, as indicated at block 570, and either the caregiver or the patient will be able to press buttons 96 to raise head section 44 assuming switch 126 is not in the on position disabling buttons 96. Board 234 will also continue to enable knee-up buttons 96 if the head section angle is not greater than limit 2, as also indicated at block 570. If the head section angle is greater than limit 2 then board 234 will continue to disable head-up buttons 96, as indicated at block 569.

If lockout switch 126 is off and button 96 is not pressed, board 234 will determine at block 572 whether the angle of head section 44, as indicated by potentiometer 218 through feedback signal 232, is greater than the limit 1 angle. If the head section angle is not greater than limit 1, then output signal 554 will not activate motor 150 to lower head section 44, as indicated at block 571, because head section will already be in the lowered position. If the head section angle is greater than limit 1 then output signal 554 will activate motor 150 to lower head section 44, as indicated at block 573.

Thus, if head section 44 is at the raised position and the caregiver moves switch 124 to the head-down position 124 when lockout switch 126 is off and button 96 is not pressed, head section will lower from the limit 4 angle, first through the limit 3 angle, then through the limit 2 angle, and finally, head section 44 will stop at the limit 1 angle. While head section 44 is above the limit 3 angle, board 234 automatically disables patient buttons 96, 100 so that the patient cannot raise head section 44 or thigh section 48. However, buttons 98, 110 are still enabled while head section 44 is above the limit 3 angle so that the patient can lower head section 44 and thigh section 48, as long as switches 126, 128 are not disabling buttons 98, 110.

When head section 44 reaches the limit 3 angle during lowering, board 234 automatically enables knee-up buttons 100 but continues to disable head-up buttons 96 so that the patient can raise thigh section 48 but cannot raise head section 44. When head section 44 reaches the limit 2 angle during lowering, board 234 automatically enables head-up buttons 96 so that the patient can raise head section 44 and thigh section 48. When head section 44 reaches the limit 1 angle, board 234 automatically disables buttons 98 and switch 124 so that motor 150 cannot be operated to lower head section 44 downwardly past the lowered position.

Figure 29:
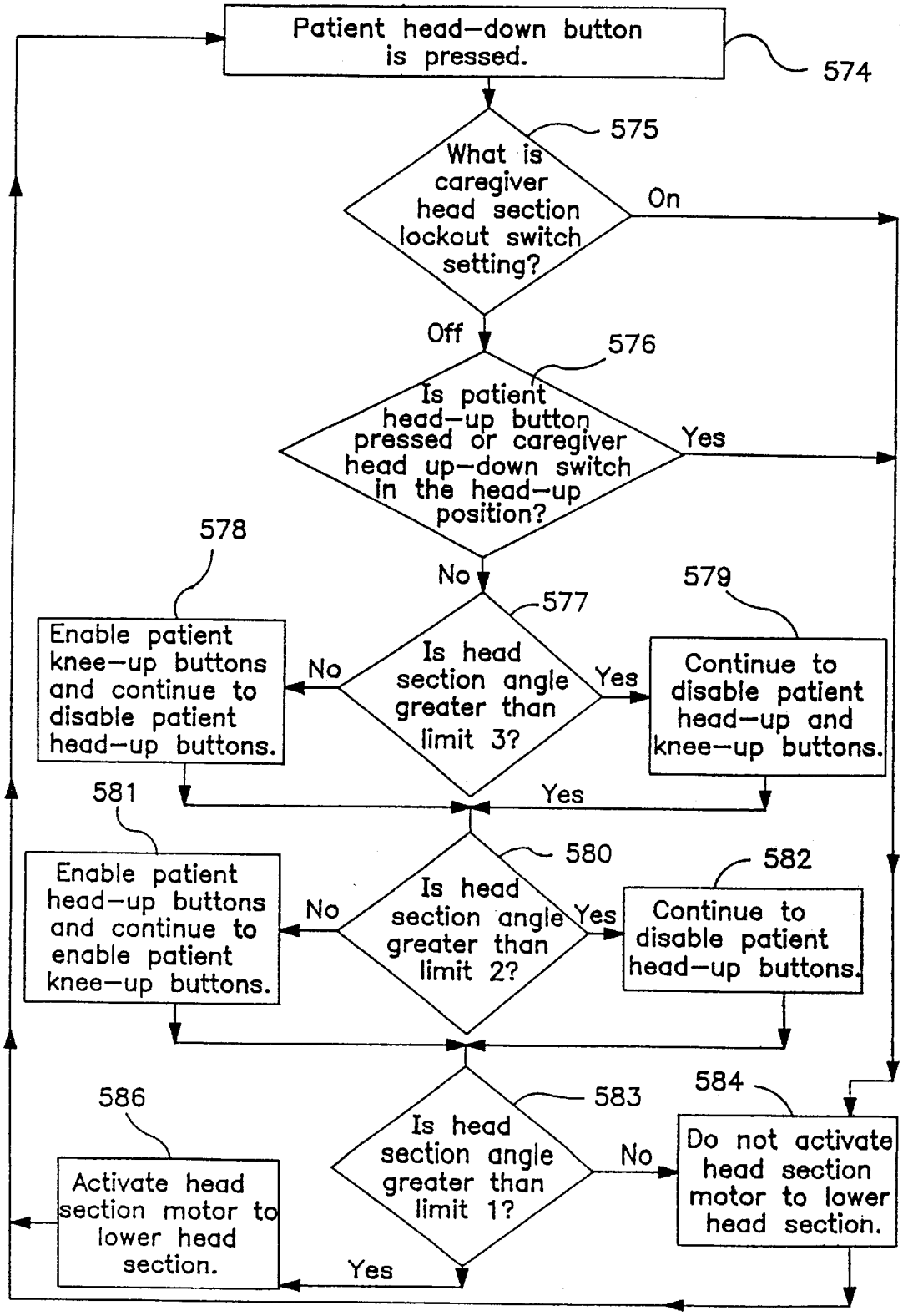
FIG. 29 is a flow chart illustrating the steps performed by the electrical system when the patient head-down button is pressed.

FIG. 29 illustrates a flow chart of the steps performed by electrical system 208 of stretcher 30 when patient head-down button 98 of patient control buttons 78 is pressed, as indicated at block 574. After the patient presses button 98, control logic board 234 receives signals 232, 542, 544, 546 and determines at block 575 whether head section lockout switch 126 is in the on position, in which case buttons 96, 98 and switch 124 are locked out from activating motor 150 to move head section 44, or the off position, in which case buttons 96, 98 and switch 124 are not locked out. If lockout switch 126 is on, output signal 554 will not activate motor 150 to lower head section 44, as indicated at block 584.

If lockout switch 126 is off, board 234 determines at block 576 whether head-up button 96 is pressed or whether switch 124 is in the head-up position. If button 96 is pressed or switch 124 is in the head-up position and switch 126 is off, then board 234 is receiving conflicting input signals 542, 544, 546 and output signal 554 will not activate motor 150 to lower head section 44, as indicated at block 584.

If lockout switch 126 is off, button 96 is not pressed, and switch 124 is not in the head-up position, board 234 will determine at block 577 whether the angle of head section 44, as indicated by potentiometer 218 through feedback signal 232, is greater than the limit 3 angle. If the head section angle is not greater than limit 3, then board 234 will enable patient knee-up button 100, as indicated at block 578, and either the caregiver or the patient will be able to press buttons 100 to raise thigh section 48 assuming switch 128 is not in the on position disabling buttons 100. Board 234 will also continue to disable head-up button 96 if the head section angle is not greater than limit 3, as also indicated at block 578. If the head section angle is greater than limit 3 then board 234 will continue to disable head-up buttons 96 and knee-up buttons 100, as indicated at block 579.

If lockout switch 126 is off and button 96 is not pressed, board 234 will determine at block 580 whether the angle of head section 44, as indicated by potentiometer 218 through feedback signal 232, is greater than the limit 2 angle. If the head section angle is not greater than limit 2, then board 234 will enable patient head-up buttons 96, as indicated at block 581, and either the caregiver or the patient will be able to press buttons 96 to raise head section 44 assuming switch 126 is not in the on position disabling buttons 96. Board 234 will also continue to enable knee-up buttons 96 if the head section angle is not greater than limit 2, as also indicated at block 581. If the head section angle is greater than limit 2 then board 234 will continue to disable head-up buttons 96, as indicated at block 582.

If lockout switch 126 is off and button 96 is not pressed, board 234 will determine at block 583 whether the angle of head section 44 is greater than the limit 1 angle. If the head section angle is not greater than limit 1, then output signal 554 will not activate motor 150 to lower head section 44, as indicated at block 584, because head section will already be in the lowered position. If the head section angle is greater than limit 1 then output signal 554 will activate motor 150 to lower head section 44, as indicated at block 586.

Thus, if head section 44 is at the raised position and the patient presses button 98 when lockout switch 126 is off, button 96 is not pressed, and switch 124 is not in the head-up position, head section will lower from the limit 4 angle, first through the limit 3 angle, then through the limit 2 angle, and finally, head section 44 will stop at the limit 1 angle. Head-up buttons 96 and knee-up buttons are enabled and disabled by board 234 when head section 44 reaches the limit 3 and limit 2 as described above with reference to movement of head section 44 in response to switch 124 being moved to the head-down position. In addition, when head section 44 reaches the limit 1 angle, board 234 automatically disables buttons 98 and switch 124 so that motor 150 cannot be operated to lower head section 44 downwardly past the lowered position, as was the case described above with reference to movement of head section 44 in response to switch 124 being moved to the head-down position.

Figure 30:
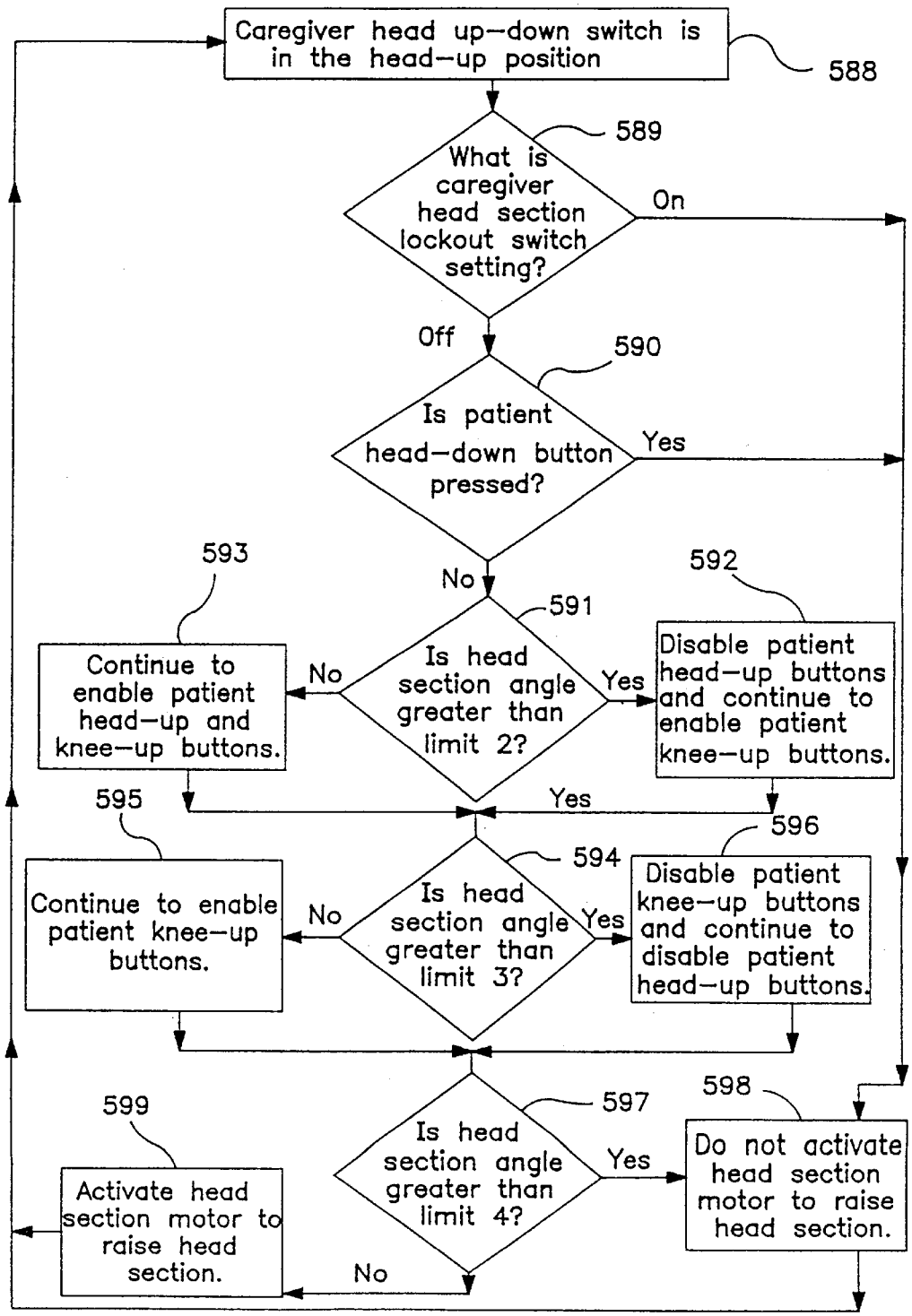
FIG. 30 is a flow chart illustrating the steps performed by the electrical system when the caregiver head up-down switch is in a head-up position.

FIG. 30 illustrates a flow chart of the steps performed by electrical system 208 of stretcher 30 when caregiver head up-down switch 124 of caregiver control switches 86 is moved to the head-up position, as indicated at block 588. After the caregiver moves switch 124 to the head-up position, control logic board 234 receives signals 232, 542, 544, 546 and determines at block 589 whether head section lockout switch 126 is in the on position, in which case buttons 96, 98 and switch 124 are locked out from activating motor 150 to move head section 44, or the off position, in which case buttons 96, 98 and switch 124 are not locked out.

If lockout switch 126 is on, output signal 554 will not activate motor 150 to raise head section 44, as indicated at block 598.

If lockout switch 126 is off, board 234 determines at block 590 whether head-down button 98 is pressed. If button 98 is pressed while switch 124 is in the head-up position and switch 126 is off, then board 234 is receiving conflicting input signals 542, 544, 546 and output signal 554 will not activate motor 150 to lower head section 44, as indicated at block 598.

If lockout switch 126 is off and button 98 is not pressed, board 234 will determine at block 591 whether the angle of head section 44 is greater than the limit 2 angle. If the head section angle is not greater than limit 2, then board 234 will continue to enable head-up buttons 96 and knee-up buttons 100, as indicated at block 593, and either the caregiver or the patient will be able to press buttons 96, 100 to raise head section 44 and thigh section 48, respectively, assuming respective switches 126, 128 are not in the on position disabling any of buttons 96, 100. If the head section angle is greater than limit 2 then board 234 will disable head-up buttons 96 but will continue to enable knee-up buttons 100, as indicated at block 592.

If lockout switch 126 is off and button 98 is not pressed, board 234 will determine at block 594 whether the angle of head section 44 is greater than the limit 3 angle. If the head section angle is not greater than limit 3, then board 234 will continue to enable patient knee-up button 100, as indicated at block 595, and either the caregiver or the patient will be able to press buttons 100 to raise thigh section 48 assuming switch 128 is not in the on position disabling buttons 100. If the head section angle is greater than limit 3 then board 234 will continue to disable head-up buttons 96 and will disable knee-up buttons 100, as indicated at block 596.

If lockout switch 126 is off and button 98 is not pressed, board 234 will determine at block 597 whether the angle of head section 44 is greater than the limit 4 angle. If the head section angle is greater than limit 4, then output signal 554 will not activate motor 150 to raise head section 44, as indicated at block 598, because head section will already be in the raised position. If the head section angle is not greater than limit 4 then output signal 554 will activate motor 150 to raise head section 44, as indicated at block 599.

Thus, if head section 44 is at the lowered position and the caregiver moves switch 124 to the head-up position 124 when lockout switch 126 is off and button 98 is not pressed, head section will raise from the limit 1 angle, first through the limit 2 angle, then through the limit 3 angle, and finally, head section 44 will stop at the limit 4 angle. While head section 44 is below the limit 2 angle, board 234 automatically enables patient buttons 96, 100 so that the patient can raise head section 44 and thigh section 48, as long as switches 126, 128 are not disabling buttons 96, 100. In addition, buttons 98, 110 are enabled while head section 44 is below the limit 3 angle so that the patient can lower head section 44 and thigh section 48.

When head section 44 reaches the limit 2 angle during raising, board 234 automatically disables head-up buttons 96 but continues to enable knee-up buttons 100 so that the patient can raise thigh section 48 but cannot raise head section 44. When head section 44 reaches the limit 3 angle during raising, board 234 automatically disables knee-up buttons 100 so that the patient cannot raise thigh section 48 and board 234 continues to disable head-up buttons 96. When head section 44 reaches the limit 4 angle, board 234 automatically disables switch 124 so that motor 150 cannot be operated to raise head section 44 upwardly past the raised position.

Figure 31:
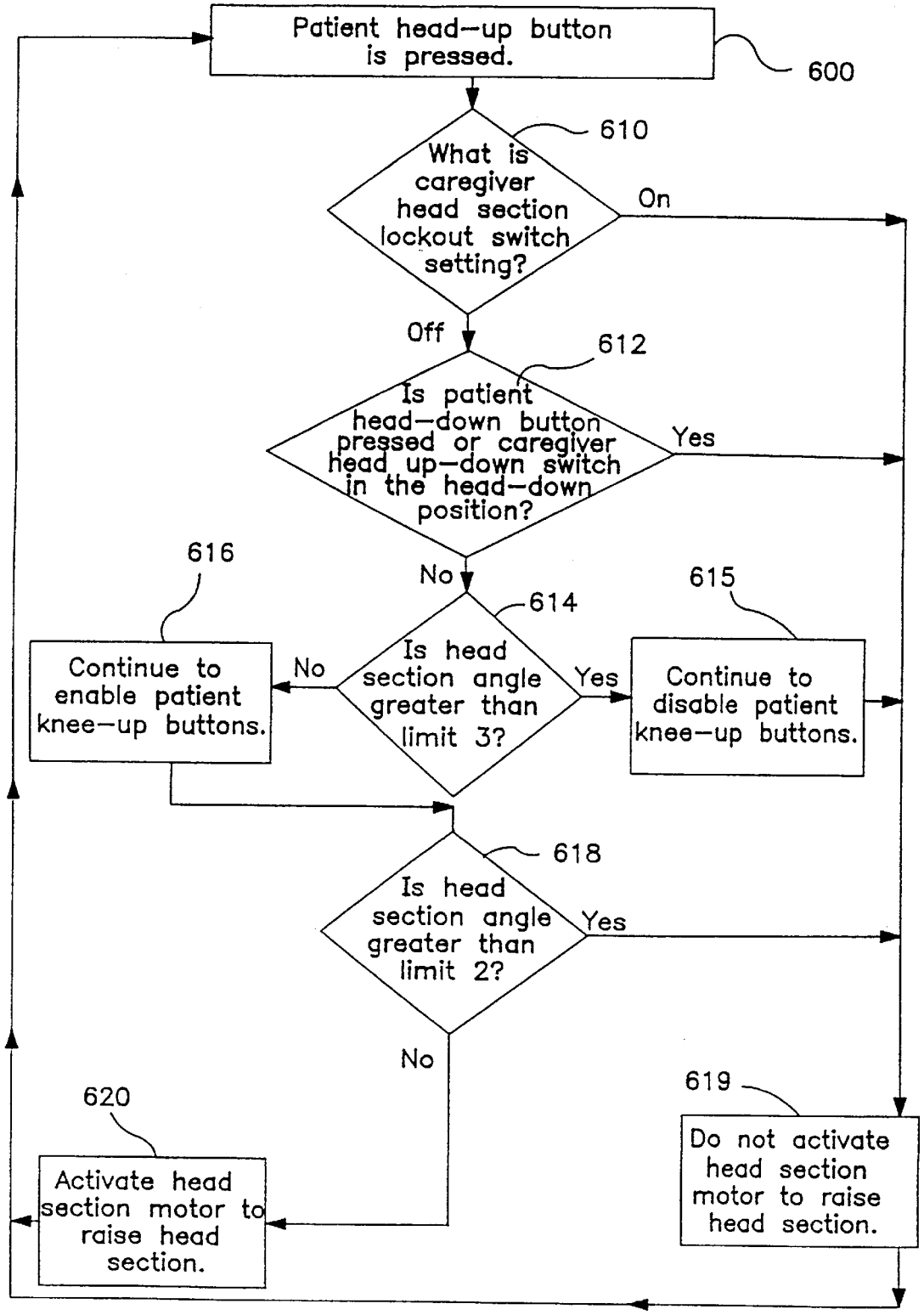
FIG. 31 is a flow chart illustrating the steps performed by the electrical system when the patient head-up button is pressed.

FIG. 31 illustrates a flow chart of the steps performed by electrical system 208 of stretcher 30 when patient head-up button 96 of patient control buttons 78 is pressed, as indicated at block 600. After head-up button 96 is pressed, control logic board 234 receives signals 232, 542, 544, 546 and determines at block 610 whether head section lockout switch 126 is in the on position, in which case buttons 96, 98 and switch 124 are locked out from activating motor 150 to move head section 44, or the off position, in which case buttons 96, 98 and switch 124 are not locked out. If lockout switch 126 is on, output signal 554 will not activate motor 150 to raise head section 44, as indicated at block 619.

If lockout switch 126 is off, board 234 determines at block 612 whether head-down button 98 is pressed or whether switch 124 is in the head-down position. If button 98 is pressed or if switch 124 is in the head-down position while button 96 is pressed and switch 126 is off, then board 234 is receiving conflicting input signals 542, 544, 546 and output signal 554 will not activate motor 150 to raise head section 44, as indicated at block 619.

If lockout switch 126 is off and button 98 is not pressed, board 234 will determine at block 614 whether the angle of head section 44 is greater than the limit 3 angle. If the head section angle is not greater than limit 3, then board 234 will continue to enable patient knee-up button 100, as indicated at block 616, and either the caregiver or the patient will be able to press buttons 100 to raise thigh section 48 assuming switch 128 is not in the on position disabling buttons 100. If the head section angle is greater than limit 3 then board 234 will continue to disable knee-up buttons 100, as indicated at block 615, and board 234 will not activate motor 150 to raise head section 44, as indicated at block 619.

If lockout switch 126 is off and button 98 is not pressed, board 234 will determine at block 618 whether the angle of head section 44 is greater than the limit 2 angle. If the head section angle is greater than limit 2, then board 234 will not activate motor 150 to raise head section 44, as indicated at block 619, because head section will be at the intermediate position and head-up buttons cannot be used to raise head section 44 past the intermediate position, as previously described. If the head section angle is not greater than limit 2, then board 234 will activate motor 150 to raise head section 44, as indicated at block 620.

Thus, if head section 44 is at the lowered position and the caregiver or the patient presses button 96 when lockout switch 126 is off and button 98 is not pressed, head section will raise from the limit 1 angle to the limit 2 angle and head section 44 will stop at the limit 2 angle. While head section 44 is below the limit 2 angle, board 234 automatically enables patient buttons 96, 100 so that the patient can raise head section 44 and thigh section 48, as long as switches 126, 128 are not disabling buttons 96, 100, as was the case described above with reference to movement of head section 44 in response to switch 124 being moved to the head-up position. In addition, buttons 100, 110 remain enabled while head section 44 is at or below the limit 2 angle so that the patient can raise and lower thigh section 48 while head section 44 is in the intermediate position, as long as switch 128 is not in the on position disabling buttons 100, 110.

Figure 32:
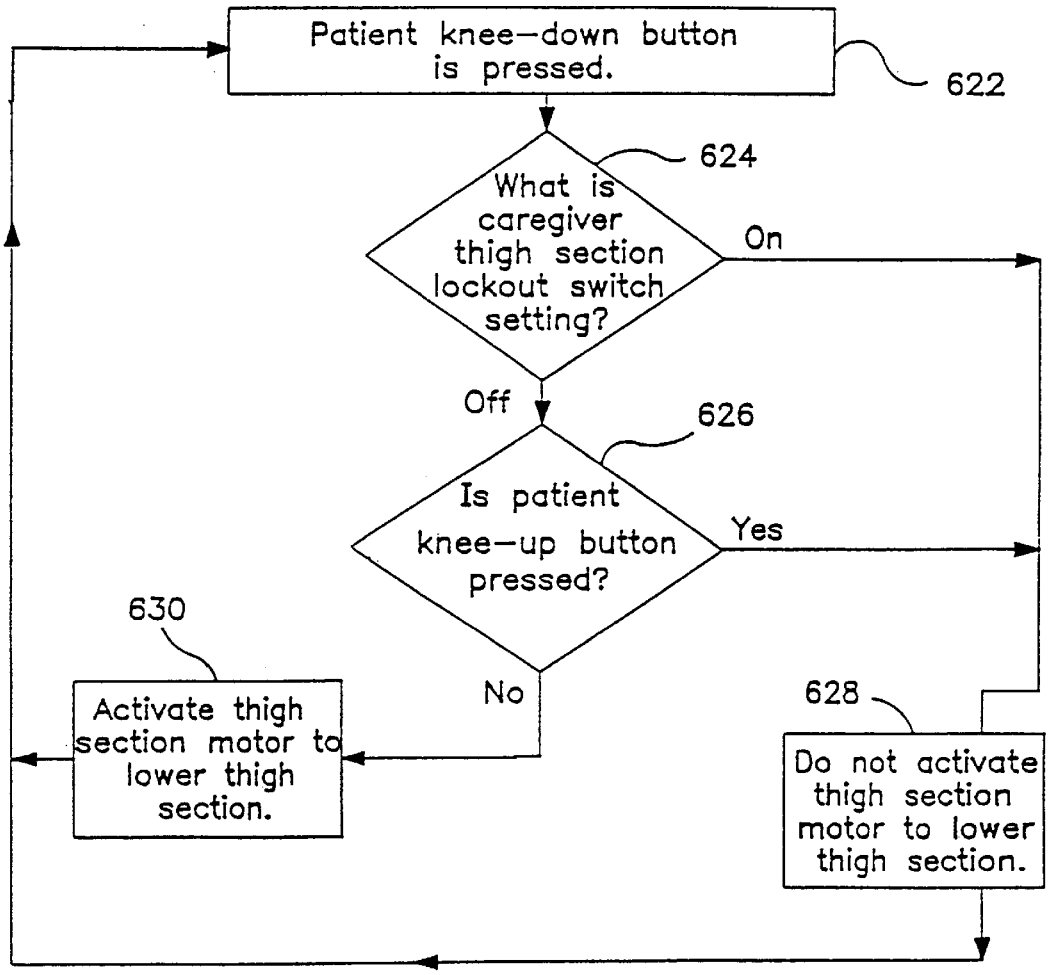
FIG. 32 is a flow chart illustrating the steps performed by the electrical system when the patient knee-down button is pressed.

FIG. 32 illustrates a flow chart of the steps performed by electrical system 208 of stretcher 30 when patient knee-down button 110 of patient control buttons 78 is pressed, as indicated at block 622. After button 110 is pressed, board 234 receives signals 232, 542, 544, 546 and determines at block 624 whether thigh section lockout switch 128 is in the on position, in which case buttons 100, 110 are locked out from activating motor 152 to move thigh section 48, or in the off position, in which case buttons 100, 110 are not locked out. If switch 128 is on, then button 110 is locked out and board 234 will not activate motor 152 to lower thigh section 48, as indicated at block 628. If switch 128 is off, then board 234 will determine at block 626 whether knee-up button 100 is pressed. If button 100 is pressed while button 110 is pressed, then board 234 is receiving conflicting input signals 542, 544 and output signal 558 will not activate motor 152 to lower thigh section 48, as indicated at block 628.

If switch 128 is off and button 100 is not pressed, output signal 558 will activate motor 152 to lower thigh section 48, as indicated at block 630. When thigh section 48 reaches the lowered position having frame member 51 engaging post 512, button 110 can still be pressed to activate motor 152 but the slip clutch mechanism will operate within gear reducer 482, as previously described.

Figure 33:
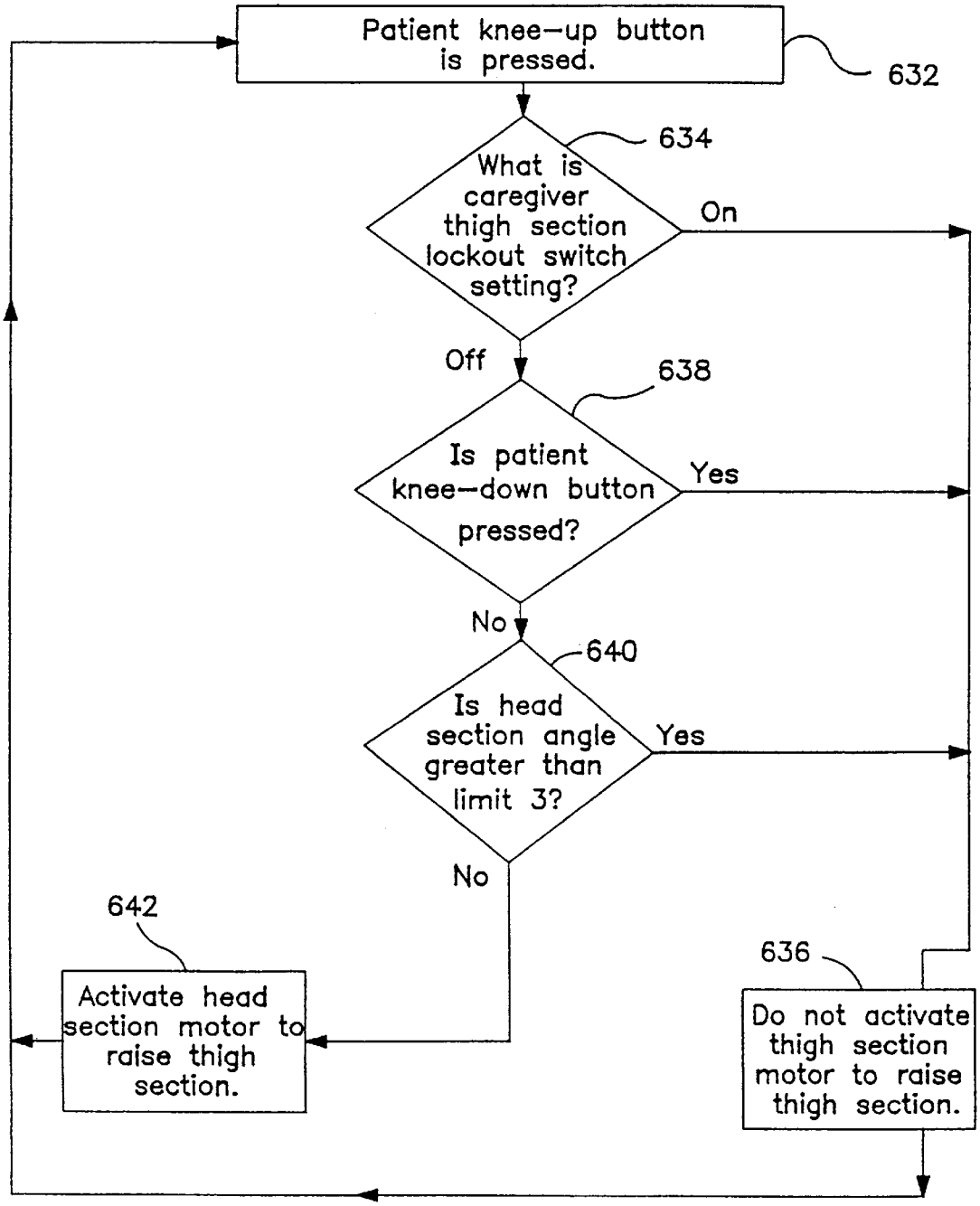
FIG. 33 is a flow chart illustrating the steps performed by the electrical system when the patient knee-up button is pressed.

FIG. 33 illustrates a flow chart of the steps performed by electrical system 208 of stretcher 30 when patient knee-up button 100 of patient control buttons 78 is pressed, as indicated at block 632. After button 100 is pressed, board 234 receives signals 232, 542, 544, 546 and determines at block 634 whether thigh section lockout switch 128 is on or off. If switch 128 is on, then button 100 is locked out and board 234 will not activate motor 152 to raise thigh section 48, as indicated at block 636. If switch 128 is off, then board 234 will determine at block 638 whether knee-down button 110 is pressed. If button 110 is pressed while button 100 is pressed, then board 234 is receiving conflicting input signals 542, 544 and output signal 558 will not activate motor 152 to raise thigh section 48, as indicated at block 636.

If switch 128 is off and button 110 is not pressed, then board 234 will determine at block 640 whether the head section angle is greater than the limit 3 angle. If the head section angle is greater than limit 3, then board 234 will not activate motor 152 to raise thigh section 48, as indicated at block 636. However, if the head section angle is not greater than limit 3, then board 234 will activate motor 152 to raise thigh section 48, as indicated at block 642. If head section is moved to the limit 3 angle while thigh section 48 is simultaneously being raised, board 234 will stop activating motor 152 to raise thigh section 48 as soon as head section 44 reaches the limit 3 angle.

When thigh section 48 reaches the raised position thigh section 48 is at an angle of approximately twenty-five degrees (25°). Button 110 can still be pressed to activate motor 152 when thigh section 48 is at the raised position but the slip clutch mechanism will operate within gear reducer 482, as previously described. Control logic board 234 is designed to deactivate buttons 100, 110 when head section 44 reaches the limit 3 angle so the patient is prevented from placing head section 44 and thigh section 48 in a position where back-to-thigh angle 84 is less than ninety degrees (90°).

As previously described, if potentiometer 218 indicates that head section 44 is at the limit 1 angle, switch 124 and button 98 cannot be used to activate motor 150 to lower head section 44 any further. In addition, if potentiometer 218 indicates that head section 44 is at or above the limit 4 angle, switch 124 and button 96 cannot be used to activate motor 150 to raise head section 44 any further. However, when head section 44 is at the limit 1 angle, the caregiver can manually lower head section 44 using hand crank 90 by a slight amount below the lowered position. Similarly, when head section 44 is at the limit 4 angle, the caregiver can manually raise head section 44 by a slight amount above the raised position.

Actuator 146 includes a conventional slip clutch mechanism (not shown) inside gear reducer 334. The slip clutch mechanism couples worm gear 338 to drive shaft 340 so that gear 338 and shaft 340 rotate together when motor 150 is activated to move head section 44. When head section 44 is at the limit 1 angle and the caregiver moves hand crank 90 to the rearwardmost position and then rotates hand crank 90 in direction 136, head section 44 will pivot downwardly past the limit 1 angle by a slight amount until head section 44 engages strut 95 of frame 40, at which point head section 44 will be slightly below the lowered position. After head section 44 engages strut 95, if the caregiver continues to rotate hand crank 90 in direction 136, the slip clutch mechanism will operate to allow shaft 340 to rotate relative to gear 338, which is held against rotation by output shaft 178 of motor 150.

When head section 44 is at the limit 4 angle and the caregiver moves hand crank 90 to the rearwardmost position and then rotates hand crank 90 in direction 134, head section 44 will pivot upwardly past the limit 4 angle by a slight amount until actuator 146 is fully extended, at which point head section 44 will be slightly above the raised position. If the caregiver continues to rotate hand crank 90 in direction 134, the slip clutch mechanism will operate to allow shaft 340 to rotate relative to gear 338, which is held against rotation as a result of output shaft 178 being held against rotation by unactivated motor 150.

Stretcher 30 is intended to be used to transport patients and to allow for patient care before, during, and after transport. Stretcher 30 can be used in all areas of a hospital including transport, PACU, and ambulatory surgery. The patient can control electrically operated head and thigh section 44, 48 articulation thus improving patient comfort and enhancing caregiver productivity.

Stretcher 30 includes caregiver control switches 86 and hand cranks 90, 92 that the caregiver can use to actuate actuators 146, 148 to position head section 44 in a vertical back position, for example, when the caregiver needs to take certain chest x-rays of the patient. In addition, stretcher 30 includes control logic board 234 that prevents patient control buttons 78 from being used by a patient to move head and thigh sections 44, 48 to a position wherein back-to-thigh angle 84 is less than ninety degrees (90°). Thigh section 48 of stretcher 30 can be raised to provide comfort to the patient, raise the legs of the patient above the heart for better blood flow, and to prevent the patient from sliding down mattress 52 when head section 44 is raised.

In addition, stretcher 30 includes CPR release mechanism 282 that does not have to be reset after use. Head section 44 moves toward the lowered position when CPR release handles 94 are actuated and head section 44 stops prior to reaching the lowered position upon release of handles 94. Thus, to operate CPR release mechanism 282, the caregiver must continuously hold one of handles 94 in the releasing position until head section 44 completely lowers to the lowered position. When the caregiver moves one of handles 94 to the releasing position, latch 292 is moved to the releasing position allowing drive mechanism 142 to back drive and head section 44 to pivot downwardly.

Control system 208 of stretcher 30 allows the patient to articulate head section 44 from limit 1, at approximately one degree (1°) of head section elevation, to limit 2, at approximately sixty degrees (60°) of head section elevation. When limit 3, at approximately sixty-three degrees (63°) of head section elevation, is reached, buttons 100 and 110 are automatically disabled thus preventing motor 152 from being activated to move thigh section 48 until head section is moved below the limit 3 elevation. When limit 4, at approximately eight-eight degrees (88°) of head section elevation, is reached, caregiver control switch 124 is automatically disabled thus preventing motor 150 from being activated to raise head section 44 any further.

Although the invention has been described in detail with reference to a certain preferred embodiment, variations and modifications exist within the scope and spirit of the invention as described and as defined in the following claims.

What is claimed is:

1. A patient-support apparatus comprising a frame having longitudinally extending and transversely spaced-apart first and second sides, a patient-support deck mounted to the frame and having longitudinally spaced-apart sections, at least one of the sections being a movable section that is coupled to the frame for pivoting movement between a raised position and a lowered position, a drive mechanism actuatable to move the movable section relative to the other deck sections, the drive mechanism being coupled to the frame and coupled to the movable section, a side guard rail having a top rail, the side guard rail being mounted to one of the sides of the frame, control buttons coupled to the drive mechanism and being engageable to actuate the drive mechanism to raise and lower the movable section, the control buttons being mounted to a vertical surface of the top rail, each button being spaced apart from a top surface of the top rail by the same distance, and each button having an engagement surface facing toward the deck, and an indicia atop the top surface of the top rail, the indicia being spaced from the control buttons and configured to indicate the location and function of the control buttons to a caregiver standing alongside the patient-support apparatus.

2. The patient-support apparatus of claim 1, wherein the engagement surfaces of the buttons are generally coplanar and cooperate to define a continuous unitary surface.

3. The patient-support apparatus of claim 2, further comprising a second indicia on the continuous unitary surface and a second indicia looks substantially the same as the first indicia.

4. The patient-support apparatus of claim 1, further comprising a second indicia on the buttons and the second indicia looks substantially the same as the first indicia.

* * * * *